US007610639B2

(12) United States Patent
Roleder et al.

(10) Patent No.: US 7,610,639 B2
(45) Date of Patent: Nov. 3, 2009

(54) HEADREST ASSEMBLY WITH IMPROVED ADJUSTABILITY FOR A MASSAGE DEVICE

(75) Inventors: Jon W. Roleder, San Diego, CA (US); William W. Chow, Del Mar, CA (US)

(73) Assignee: Earthlite Massage Tables, Inc., Vista, CA (US)

( * ) Notice: Subject to any disclaimer, the term of this patent is extended or adjusted under 35 U.S.C. 154(b) by 352 days.

(21) Appl. No.: 11/452,835

(22) Filed: Jun. 13, 2006

(65) Prior Publication Data

US 2006/0288484 A1 Dec. 28, 2006

Related U.S. Application Data

(60) Provisional application No. 60/690,213, filed on Jun. 14, 2005.

(51) Int. Cl.
*A47C 20/02* (2006.01)

(52) U.S. Cl. ..... 5/622; 5/638; 5/640

(58) Field of Classification Search ..... 5/622, 5/621, 632, 636–638, 640, 643, 725; 297/408, 297/409, 391, 900
See application file for complete search history.

(56) References Cited

U.S. PATENT DOCUMENTS

| | | | | |
|---|---|---|---|---|
| 2,107,962 | A | 2/1938 | Sheasby | |
| 4,345,347 | A | 8/1982 | Kantor | |
| 4,366,985 | A * | 1/1983 | Leffler | 297/409 |
| 4,514,995 | A | 5/1985 | Curtis et al. | |
| 4,823,776 | A | 4/1989 | Foster et al. | |
| 4,840,429 | A * | 6/1989 | Stockl | 297/409 |
| 4,943,041 | A | 7/1990 | Romein | |
| 5,009,170 | A | 4/1991 | Spehar | |
| 5,177,823 | A | 1/1993 | Riach | |
| 5,335,676 | A | 8/1994 | O'Brien | |
| 5,347,668 | A | 9/1994 | Manning | |
| 5,393,938 | A | 2/1995 | Bumbalough | |
| 5,427,436 | A * | 6/1995 | Lloyd | 297/408 |
| 5,520,623 | A | 5/1996 | Williams | |
| 5,606,755 | A | 3/1997 | Romein | |
| 5,676,062 | A | 10/1997 | Lloyd | |
| 5,864,900 | A | 2/1999 | Landau | |
| 5,913,271 | A | 6/1999 | Lloyd | |

(Continued)

OTHER PUBLICATIONS

Transmittal of International Search Report and Written Opinion for PCT/US06/22969 (related to the present application), publication date Aug. 27, 2008, Earthlite Massage Tables, Inc.

*Primary Examiner*—Robert G Santos
(74) *Attorney, Agent, or Firm*—Roeder & Broder LLP

(57) ABSTRACT

A headrest assembly (212) for supporting a face of a user (16) of a massage device (10) includes a resilient assembly (220) that supports the face of the user (15), a support arm assembly (222) that is secured to the massage device (10), and an adjuster assembly (224) that can be used to adjust the position of the resilient assembly (220) relative to the support arm assembly (222). The adjuster assembly (224) can include a first adjuster subassembly (240A) that forms a first, four bar type linkage assembly and a second adjuster subassembly (240B) that forms a second, four bar type linkage assembly. The four bar type linkage assemblies allow for improved range of movement and adjustment of the resilient assembly.

22 Claims, 14 Drawing Sheets

U.S. PATENT DOCUMENTS

| | | | | |
|---|---|---|---|---|
| 5,943,965 | A | 8/1999 | Riach et al. | |
| 5,970,546 | A | 10/1999 | Danis | |
| 5,974,979 | A | 11/1999 | Grady et al. | |
| 6,042,184 | A | 3/2000 | Kofoed | |
| 6,151,734 | A | 11/2000 | Lawrie | |
| 6,182,578 | B1 | 2/2001 | Fanuzzi | |
| 6,192,809 | B1 | 2/2001 | Riach et al. | |
| 6,397,414 | B1 * | 6/2002 | Lloyd | 5/622 |
| 6,594,839 | B1 | 7/2003 | Papay | |
| 6,705,234 | B1 | 3/2004 | Miller et al. | |
| 6,739,006 | B2 * | 5/2004 | Borders et al. | 5/622 |
| 6,754,923 | B2 * | 6/2004 | Borders et al. | 5/624 |
| 6,928,679 | B1 | 8/2005 | Gross | |
| 7,080,420 | B2 * | 7/2006 | Damron | 5/640 |
| 7,089,613 | B2 | 8/2006 | Cohen | |
| 7,093,313 | B2 * | 8/2006 | DeBraal et al. | 5/622 |
| 7,225,485 | B2 | 6/2007 | Binder | |
| 7,424,759 | B2 * | 9/2008 | Damron | 5/641 |
| 2002/0170115 | A1 * | 11/2002 | Borders et al. | 5/600 |
| 2002/0170116 | A1 * | 11/2002 | Borders et al. | 5/600 |
| 2006/0288484 | A1 * | 12/2006 | Roleder et al. | 5/622 |
| 2006/0288487 | A1 * | 12/2006 | Roleder et al. | 5/638 |
| 2006/0290193 | A1 * | 12/2006 | Roleder et al. | 297/900 |
| 2006/0290194 | A1 * | 12/2006 | Roleder et al. | 297/900 |
| 2006/0290195 | A1 * | 12/2006 | Roleder et al. | 297/900 |
| 2009/0077749 | A1 * | 3/2009 | Roleder et al. | 5/638 |

* cited by examiner

HEADREST ASSEMBLY WITH IMPROVED ADJUSTABILITY FOR A MASSAGE DEVICE

RELATED APPLICATION

This Application claims the benefit on U.S. Provisional Application Ser. No. 60/690,213 filed on Jun. 14, 2005. The contents of U.S. Provisional Application Ser. No. 60/690,213 are incorporated herein by reference.

BACKGROUND

As the benefits of therapeutic massage are becoming more widely appreciated, more and more people are participating in therapeutic massage. A typical massage table allows the patient to be resting while receiving a massage. A typical massage chair allows the patient to be sitting while receiving a massage. Both types of massage devices include a headrest that supports the head of the patient during a massage. Important features for massage devices include high strength, ease of use, adjustability, light weight, and comfort.

SUMMARY

The present invention is directed to a headrest assembly for supporting a face of a user of a massage device. The headrest assembly includes a resilient assembly that supports the face of the user, a support arm assembly that is secured to the massage device, and an adjuster assembly that can be used to adjust the position of the resilient assembly relative to the support arm assembly. In one embodiment, the adjuster assembly includes a first adjuster subassembly that forms a first, four bar type linkage assembly. As an overview, in certain embodiments, the four bar type linkage assembly allows for improved range of movement and adjustment of the resilient assembly.

In one embodiment, the adjuster assembly includes a second adjuster subassembly that is spaced apart from the first adjuster subassembly. The second adjuster subassembly can also form a second, four bar type linkage assembly. The headrest assembly can include a support frame that supports the resilient assembly. In one embodiment, the support frame forms a portion of the first, four bar type linkage assembly and a portion of the second, four bar type linkage assembly.

The first adjuster subassembly can also include (i) a first linkage that extends between the support arm assembly and the support frame, (ii) an adjuster beam that extends away from the support arm assembly, and (iii) second linkage that extends between the adjuster beam and the support frame. In one embodiment, pivoting of the first linkage relative to the support arm assembly causes the support frame to move up or down relative to the support arm assembly and pivoting of the adjuster beam relative to the support arm assembly causes the support frame to pivot relative to the support arm assembly.

Moreover, the support frame can include an ear region and a forehead region and wherein the first linkage is connected to the support frame near the ear region and the second linkage is connected to the support frame near the forehead region.

Further, in one embodiment, (i) the first linkage is pivotable connected to the support arm assembly and the support frame, (ii) the adjuster beam is pivotably connected to the support arm assembly, and (iii) second linkage is pivotable connected to the adjuster beam and the support frame. Moreover, the first linkage and the adjuster beam can rotate relative to each other.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which:

FIG. 2BB is a partly exploded side view of another embodiment of a portion of a support arm having features of the present invention;

DESCRIPTION

Figure 1:
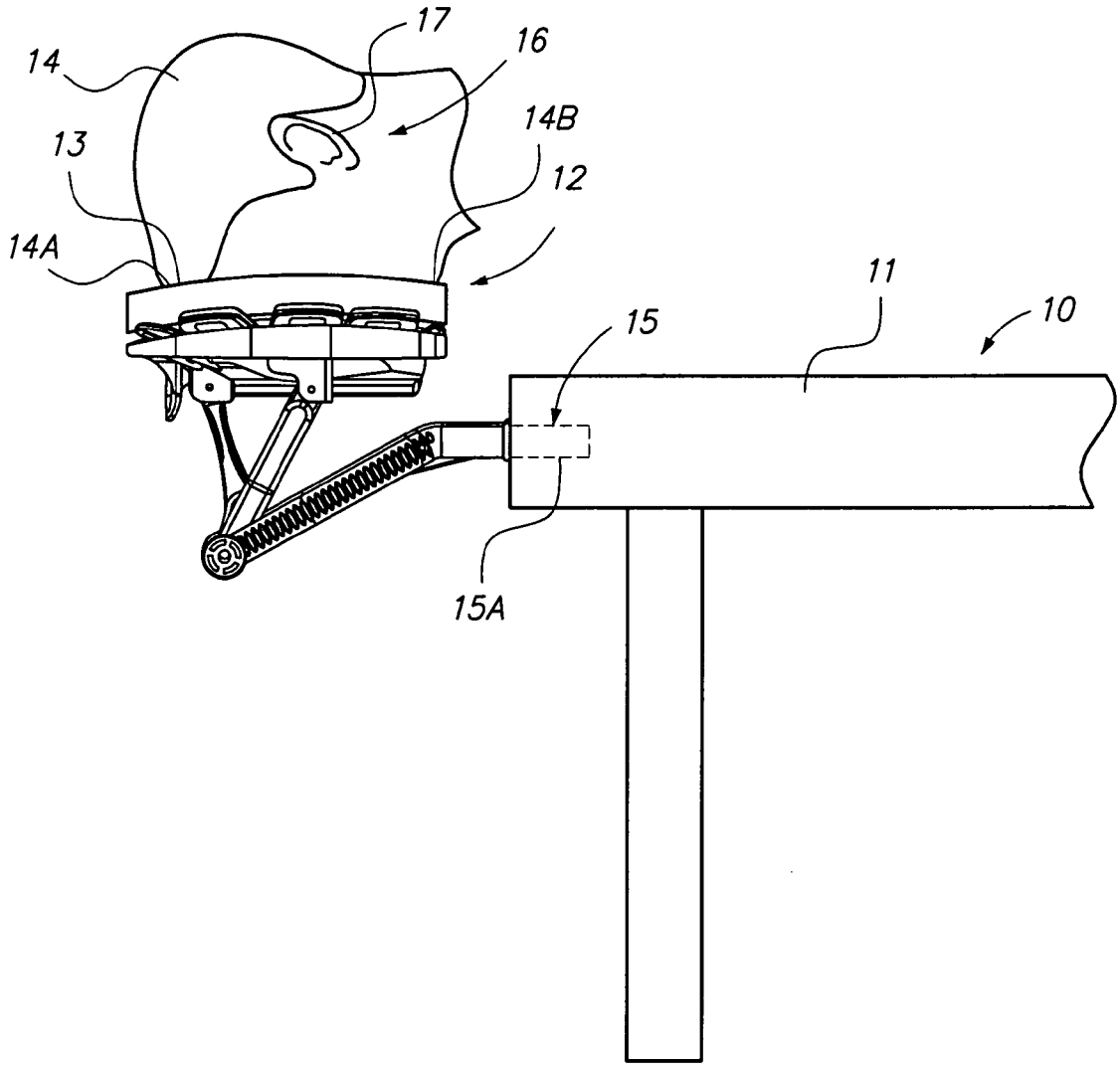
FIG. 1 is a simplified, side view of a portion of first embodiment of a massage device having features of the present invention.

FIG. 1 is a simplified, side view of a portion of a massage device 10 having features of the present invention. The design of the massage device 10 can be varied. In FIG. 1, the massage device 10 is a portable, folding massage table that includes a base 11, and a headrest assembly 12. One embodiment of a massage table is disclosed U.S. Pat. No. 5,009,170, issued to Spehar, the contents of which are incorporated herein by reference. Alternatively, for example, the massage device 10 can be another type of massage device, such as a massage chair. One embodiment of a massage chair is disclosed U.S. Pat. No. 6,729,690, issued to Roleder et al., the contents of which are incorporated herein by reference.

As an overview, in certain embodiments, the headrest assembly 12 provides improved comfort and support to a face 13 and/or head 14 (illustrated as an oval) of a person 16 (also referred to as the "user") using the massage device 10. One ear 17 of the person 16 is also illustrated in FIG. 1. Further, the headrest assembly 12 provides improved adjustability to the user.

Additionally or alternatively, the headrest assembly 12 can be lighter in weight and/or have a smaller form factor than comparable prior art headrest assemblies (not shown). Further, as provided herein, in certain embodiments, the headrest assembly 12 includes independent type suspension that can better respond to the individual weight and shape of the head 14 and can curve to better "wrap", "envelope" and/or "cradle" the face. Moreover, the headrest assembly 12 can have a relatively low profile.

In FIG. 1, the headrest assembly 12 is removable and adjustably extends and cantilevers away from the front of the massage base 11. Alternatively, the headrest assembly 12 can be positioned at another location. For example, for a massage chair, the headrest assembly 12 would extend generally upward at an angle.

In one embodiment, the massage device 10 includes a headrest receiver assembly 15 (illustrated in phantom) that can be used to selectively secure the headrest assembly 12 to the massage device 10. In FIG. 1, the headrest receiver assembly 15 includes a first headrest receiver (not shown) and a spaced apart second headrest receiver 15A that are secured to the front wall of the massage device 10. In this embodiment, each of the headrest receivers 15A is a generally right cylindrical shaped aperture that extends through the front wall of the massage device 10.

Alternatively, the headrest receiver assembly 15 can have another design or can be positioned at another location on the massage device 10.

Figure 2A:
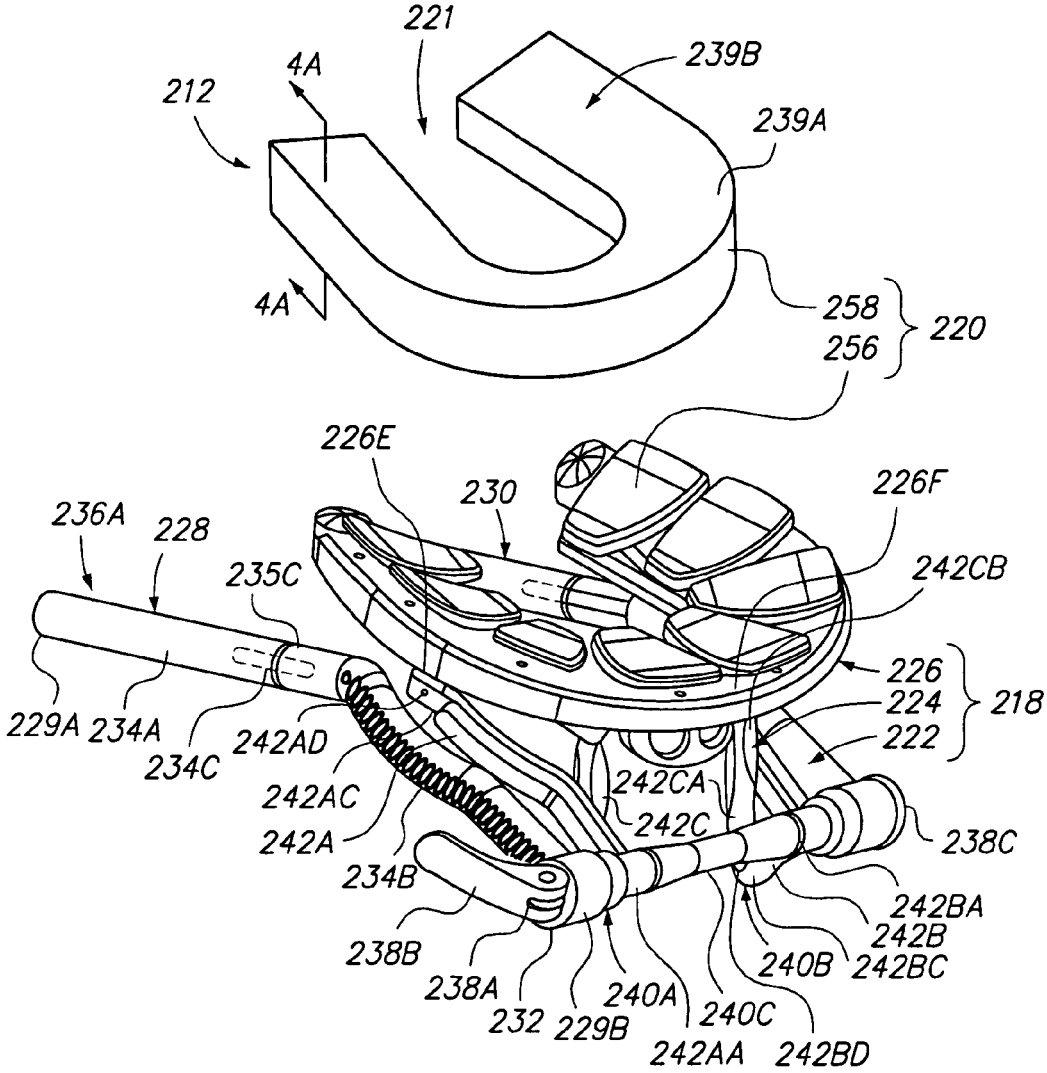
FIG. 2A is a partly exploded perspective view of a headrest assembly having features of the present invention.

FIG. 2A is a partly exploded perspective view of a first embodiment of a headrest assembly 212 having features of the present invention. In this embodiment, the headrest assembly 212 includes a frame assembly 218 and a resilient assembly 220. The size, shape and design of each of these assemblies 218, 220 can be varied to achieve the desired design characteristics of the headrest assembly 212. Further, the resilient assembly 220 defines a face opening 221 for receiving a portion of the face of the user 14. In one embodiment, the resilient assembly 220 is contoured so that one size fits all faces.

In FIG. 2A, the frame assembly 218 includes a support arm assembly 222, an adjuster assembly 224, and a support frame 226. The support arm assembly 222 couples the other elements of the headrest assembly 212 to the rest of the massage device 10 (illustrated in FIG. 1). In one embodiment, the support arm assembly 222 includes a first support arm 228, a spaced apart second support arm 230 that is somewhat parallel to the first support arm 228, and an arm connector 232 that couples the support arms 228, 230 together. In this embodiment, a portion of each support arm 228, 230 extends into a corresponding headrest receiver 15A (illustrated in FIG. 1) in the massage base 11 (illustrated in FIG. 1) to facilitate selective attachment and detachment of the headrest assembly 212 to the massage base 11. In one embodiment, the support arms 228, 230 are spaced apart approximately eight inches and the headrest receivers 15A are spaced apart approximately eight inches. Alternatively, the spacing between the support arms 228, 230 and the headrest receivers 15A can be greater than or less than eight inches.

Further, the amount in which the support arms 228, 230 extend into the massage base 11 can be moved to adjust the position of the headrest assembly 212 relative to the massage base 11. With this design, the headrest assembly 212 can be moved relative to the massage base 11 to suit the needs of the patient being massaged.

For example, the support arm assembly 222 could be designed with more than two or less than two support arms 228, 230 or the support arms 228, 230 could be secured to the massage device 10 in another fashion.

The design, shape and length of each support arm 228, 230 can be varied depending upon the design requirements of the massage device 10. In FIG. 2A, each support arm 228, 230 (i) is a rigid, generally tubular shaped beam, (ii) includes an arm first end 229A that is inserted into the massage base 11 and an arm second end 229B, and (iii) is slightly bent downward at an obtuse angle to provide a range to adjust the height of the resilient assembly 220.

In one embodiment, each of the support arms 228, 230 includes a first arm section 234A, a second arm section 234B, and a section connector 234C (illustrated in phantom). In this embodiment, the first arm section 234A can be selectively attached to and detached from the second arm section 234B, and the section connector 234C couples the arm sections 234A, 234B together. In this embodiment, each of the support arms 228, 230 can be compactly folded for storage within the massage device 10. Alternatively, for example, one or both of the support arms 228, 230 can be made as a unitary structure, can include more than two arm sections, and/or can be made without the section connector 234C.

In FIG. 2A, the support arms 228, 230 are illustrated in an assembled position 236A in which a connector end 235A (illustrated in FIG. 2B) of the first arm section 234A is inserted into a section aperture 235B (illustrated in FIG. 2B in phantom) at a connector end 235C of the second arm section 234B. In the assembled position 236A, the support arms 228, 230 are ready for attachment to the massage base 11. In the assembled position 236A, the arm sections 234A, 234B are attached together to form a relatively rigid beam.

Figure 2B:
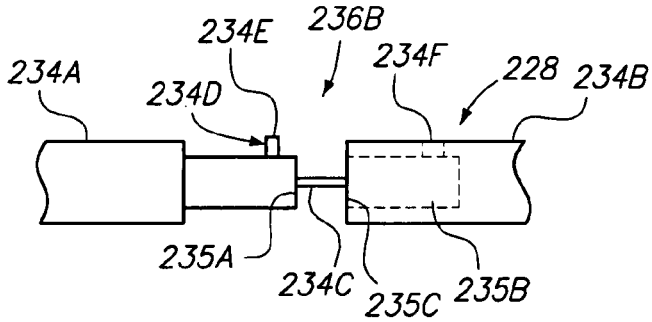
FIG. 2B is a partly exploded side view of a portion of a support arm having features of the present invention.
Figure 2B:
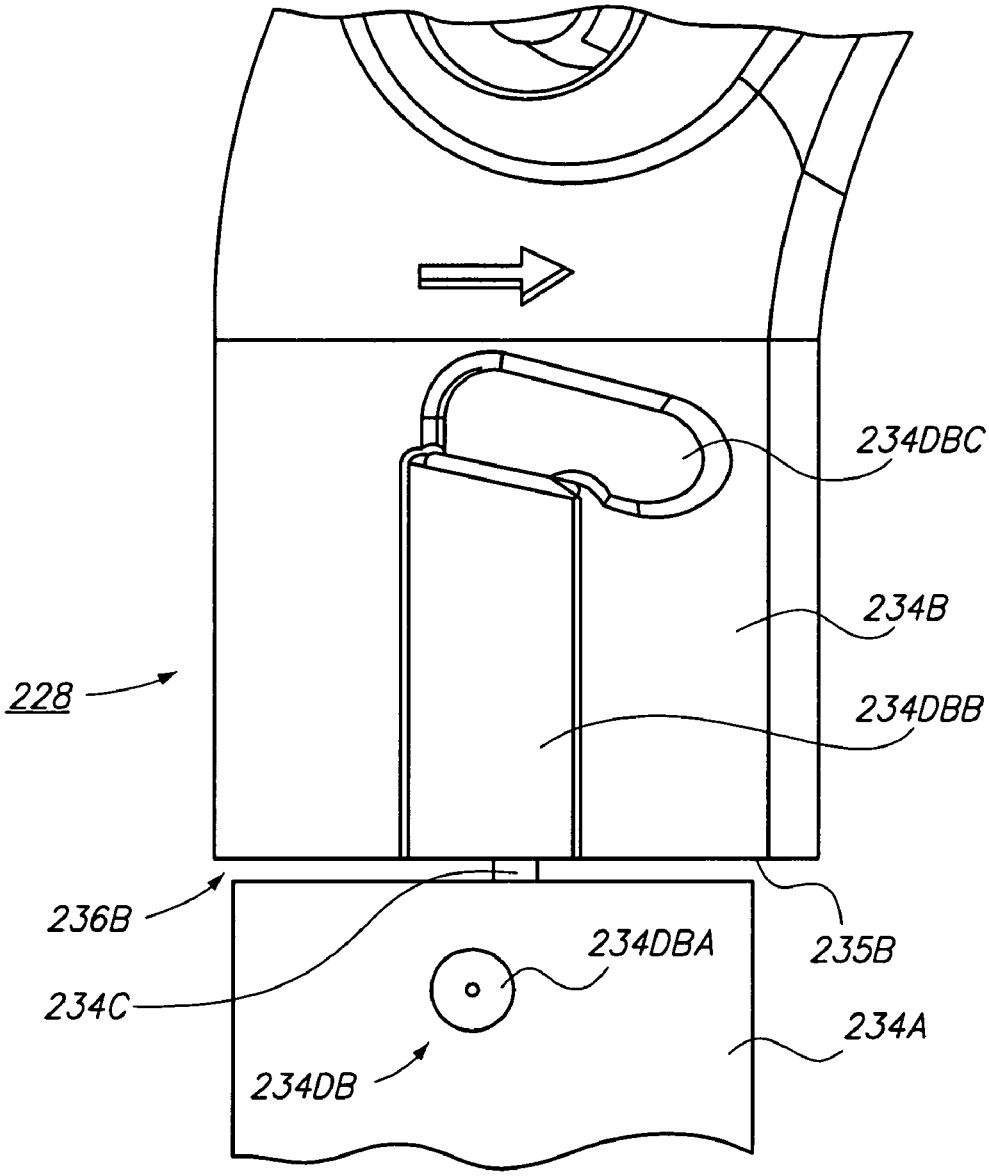

FIG. 2B illustrates a portion of the first support arm 228 has been partly moved to a downsized position 236B in which the first arm section 234A has been removed from the section aperture 235B, the first arm section 234A is positioned away from the second arm section 234B, and the arm sections 234A, 234B are still connected with the section connector 234C. The second support arm 230 can have a similar design. In this embodiment, the connector end 235A of the first arm section 234A has been removed from the connector end 235C of the second arm section 234B.

In should be noted that after the first arm section 234A has been removed from the section aperture 235B, the arms sections 234A, 234B can be pivoted relative to the section connector 234C so that the arms sections 234A, 234B are folded and are substantially side by side. Stated in another fashion, in the downsized position 236B, the arm sections 234A, 234B can be moved relative to each other. In the downsized position 236B, the head rest assembly 212 is ready to be stored below the massage device 10.

Non-exclusive examples of suitable materials for each arm section 234A, 234B include metal alloys and other metals, carbon fiber, composite materials, fiberglass, plastic and/or wood.

The section connector 234C connects the arm sections 234A, 234B of each support arm 228, 230 together and allows the arm sections 234A, 234B to be moved between the positions 236A, 236B. In one embodiment, the section connector 234C includes a resilient member that is attached to each of the arm sections 234A, 234B and that secures the arm sections 234A, 234B together. For example, the section connector 234C can be an elastic cord, a band or any other suitably resilient material. In one embodiment, the section connector 234C can include a first end (not shown) that is fixedly secured to the first arm section 234A, and a second end (not shown) that is fixedly secured to the second arm section 234B Additionally, each support arm 228, 230 can include a section latch 234D that selectively locks the arm sections 234A, 234B together. The design of the section latch 234D can vary. In FIG. 2B, the section latch 234D includes a pin 234E that is secured to and moves relative to the first arm section 234A and a pin opening 234F (illustrated in phantom) in the second arm section 234B that receives the pin 234E. In this embodiment, during insertion of the first arm section 234A into the section aperture 235B, the pin 234E can be depressed. Subsequently, after the first arm section 234A is inserted into the section aperture 235B and the pin 234E is aligned with the pin opening 234F, the pin 234E can move up and slide into the pin opening 234F to fixedly couple the arm sections 234A, 234B together. In one embodiment, the pin 234E is biased to move outward.

It should be noted that the arm sections 234A, 234B can be connected and/or locked in different fashion than that illustrated in FIG. 2B. For example, one of the arm sections 234A, 234B can include an externally threaded surface that engages an internally threaded surface in the other arm section 234A, 234B.

Alternatively, for example, the arm sections 234A, 234B can be made in a telescoping type fashion.

FIG. 2BB illustrates yet another embodiment in which a portion of the first support arm 228 has been partly moved to the downsized position 236B in which the first arm section 234A has been removed from the section aperture 235B, the first arm section 234A is positioned away from the second arm section 234B, and the arm sections 234A, 234B are still connected with the section connector 234C. However, in this embodiment, the section latch 234DB is slightly different. More specifically, in this embodiment, the section latch 234DB includes a protrusion 234DBA on the first arm section 234A that extends into a corresponding slot 234DBB in the second arm section 234B. Upon insertion, the first arm section 234A can be rotated relative to the second arm section 234B with protrusion 234DBA fitting into a detent 234DBC in the second arm section 234B.

Referring back to FIG. 2A, the arm connector 232 connects the support arms 228, 230 together. In one embodiment, the arm connector 232 connects the arm second end 229B of the support arms 228, 230 together and inhibits relative rotation between the support arms 228, 230. With this design, the arm first ends 229A of each of the support arms 228, 230 are aligned and can be easily inserted concurrently into the headrest receiver assembly 15 of the massage base 11. Stated in another fashion, the support arms 228, 230 are timed together, the arm connector 232 inhibits relative pivoting of the support arms 228, 230, and the support arms 228, 230 remain parallel when the support arms 228, 230 are not engaging the headrest receiver assembly 15 so that the headrest assembly 212 can be inserted into the massage base 11 with one hand.

The design of the arm connector 232 can be varied. In FIG. 2A, the arm connector 232 includes a connector pin 238A, a connector latch 238B, and a pin nut 238C. In this embodiment, the connector pin 238A extends through the arm second end 229B of each of the support arms 228, 230.

Figure 2C:
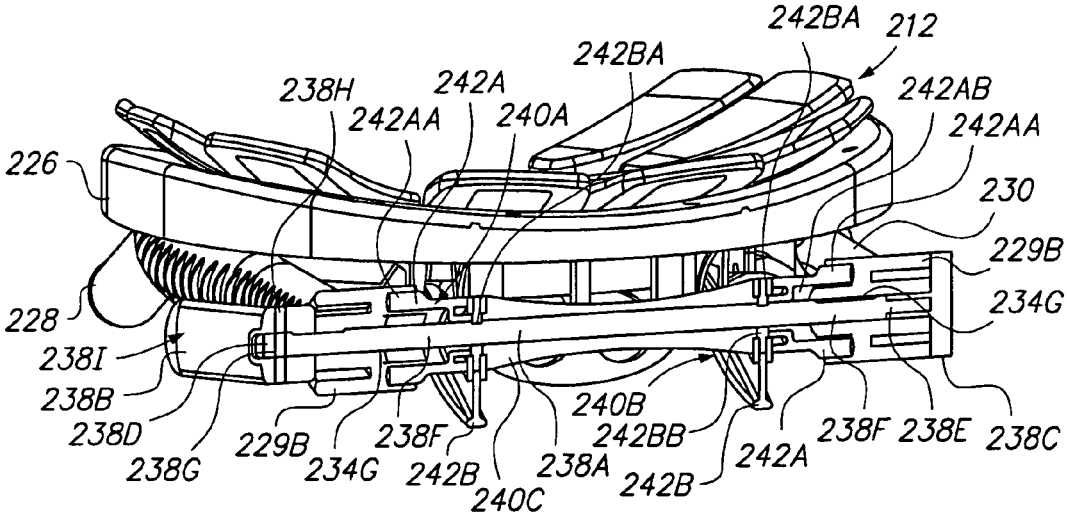
FIG. 2C is a cut-away view of a portion of the headrest assembly of FIG. 2A.

FIG. 2C is a cut-away view of a portion of the headrest assembly 212. FIG. 2C illustrates the connector pin 238A, the connector latch 238B, and that the arm second end 229B of each support arm 228, 230 includes an arm aperture 234G that is sized to receive and engage the connector pin 238A. In this embodiment, the connector pin 238A is generally pin shaped, extends transversely between the support arms 228, 230, includes a latch end 238D and an opposed nut end 238E, and a pair of spaced apart arm engagement regions 238F. For example, the latch end 238D can include an aperture 238G for receiving a latch pin 238H for pivotable securing the connector latch 238B to the connector pin 238A, and the nut end 238E can include an externally threaded surface for engaging the pin nut 238C. In one embodiment, each arm engagement region 238F can have a generally rectangular shaped cross-section.

The connector latch 238B selectively clamps the components retained by the connector pin 238A together. In FIG. 2C, the connector latch 238B is a flip type latch that can be selectively moved between a locked position 238I and an unlocked position (not shown). In this embodiment, the connector latch 238B is selectively rotated relative to the latch pin 238H during movement between the positions 238I. With this design, the connector latch 238B can be selectively rotated relative to the connector pin 238A to selectively urge support arms 228, 230 together in the locked position 238I or to allow the support arms 228, 230 to move apart in the unlocked position. In this embodiment, the connector latch 238B is a "quick release" type of mechanism that allows for one-handed locking/unlocking, while using another hand is used to adjust position. However, other suitable latches can be used that carry out the intent of the present invention provided herein. For example, the connector latch 238B can be a nut (not shown) that engages an externally threaded surface at the latch end 238D of the connector pin 238A.

In one embodiment, the arm apertures 234G in each support arm 228, 230 can be a generally rectangular shaped opening that is sized and shaped to engage one of the arm engagement regions 238F of the connector pin 238A. With this design, the connector pin 238A inhibits relative rotation between the support arms 228, 230 irregardless of the orientation of the connector latch 238B. Alternatively, for example, each arm aperture 234G and each arm engagement region 238F can have a triangular shape, a hexagon shape, an oval shape, or an octagonal shape.

With this design, the support arms 228, 230 do not rotate relative to each other, and the support arms 228, 230 remain in substantially the same orientation relative to one another whether the support arms 228, 230 are positioned within the massage base 11 (engaging the headrest receiver assembly 15), or whether the support arms 228, 230 are removed from the massage base 11 (not engaging the headrest receiver assembly 15). With this design, assembly between the headrest assembly 212 and the massage base 11 is facilitated and requires less or no alignment of the support arms 228, 230 relative to one another during insertion of the support arms 228, 230 into the headrest receiver assembly 15 of the massage base 11.

Referring back to FIG. 2A, the resilient assembly 220 includes an upper face region 239A (e.g. a forehead region) that engages and supports an upper portion 14A (illustrated in FIG. 1) (e.g. a forehead) of the head 14 and a lower face region 239B (e.g. a chin region) that engages and supports a lower portion 14B (illustrated in FIG. 1) (e.g. a chin) of the head 14. It should be noted that in FIG. 2A, the arm connector 232 is located near the distal end of the headrest assembly 212 and the upper face region 239A (near or past the forehead/upper portion 14A of the face of the user) instead of near the lower face region 239B (under or near the chin area/lower portion 14B of the face of the user). As a result thereof, the arm connector 232 is less visible and the user is less likely to touch the arm connector 232 with their chin when they have their face positioned in the headrest assembly 212. Stated in another fashion, the likelihood of a user of the headrest assembly 212 inadvertently contacting his or her face against any portion of the arm connector 232 is reduced or eliminated. Additionally, the headrest assembly 212 has a more aesthetically pleasing appearance due to the lack of a visible crossbar as viewed from above the headrest assembly 212.

Additionally, the headrest assembly 12 can include an ear region that is positioned near where the ear of person is at relative to the headrest assembly 12.

Alternatively, in other embodiments, the actual positioning of the arm connector 232 can different from that illustrated in FIG. 2A.

The adjuster assembly 224 can be used to adjust the position of the resilient assembly 220 up and down, and tilt the resilient assembly 220 to suit the comfort requirements of the user. The design of the adjuster assembly 224 can be varied. In FIG. 2A, the adjuster assembly 224 cooperates with the support frame 226 to form a pair of spaced apart, four bar type linkages that can be used to selectively move the support frame 226 and the resilient assembly 220 up and down and to tilt the support frame 226 and the resilient assembly 220.

In the embodiment illustrated in FIG. 2A, the adjuster assembly 224 includes a first adjuster subassembly 240A and a second adjuster subassembly 240B. Additionally, the adjuster assembly 224 can include an adjuster spacer 240C that maintains the adjuster subassemblies 240A, 240B spaced apart. Alternatively, for example, the adjuster assembly 224 can include more than two or less than two adjuster subassemblies 240A, 240B.

In FIGS. 2A and 2C, each adjuster subassembly 240A, 240B includes (i) a first linkage 242A that extends between the arm connector 232 and the bottom of the support frame 226, (ii) an adjuster beam 242B that cantilevers away from the arm connector 232, and (iii) a second linkage 242C that extends between the adjuster beam 242B and the support frame 226. In one embodiment, for each adjuster subassembly 240A, 240B (i) an FL first end 242AA of the first linkage 242A includes an aperture 242AB that receives the connector pin 238A so that the first linkage 242A can pivot relative to the connector pin 238A; (ii) an FL second end 242AC of the first linkage 242A includes an aperture (not shown in FIGS. 2A or 2C) and an FL pin 242AD extends through the aperture to pivotably connect the first linkage 242A to the support frame 226; (iii) an AB first end 242BA of the adjuster beam 242B includes an AB aperture 242BB that receives the connector pin 238A so that the adjuster beam 242B can pivot relative to the connector pin 238A; (iv) an AB second end 242BC includes an aperture (not shown in FIGS. 2A or 2C) for receiving an AB pin 242BD to pivotably connect the adjuster beam 242B to the second linkage 242C; (v) an SL first end 242CA of the second linkage 242C includes an aperture for receiving the AB pin 242BD to pivotably connect the adjuster beam 242B to the second linkage 242C; and (vi) an SL second end 242CB includes an aperture (not shown in FIGS. 2A or 2C) and an SL pin 242CC (illustrated in FIG. 2E) extends through the aperture to pivotably connect the second linkage 242C to the bottom of the support frame 226.

In one embodiment, each first linkage 242A is coupled to the support frame 226 near an ear region 226E of the support frame 226 and each second linkage is coupled to the support frame 226 near a forehead region 226F of the support frame 226.

Referring to FIG. 2C, moving right to left on the connector pin 238A, the components are aligned as follows: (i) the arm second end 229B of the first support arm 228; (ii) the FL first end 242AA of the first linkage 242A for the first adjuster subassembly 240A; (iii) the AB first end 242BA of the adjuster beam 242B for the first adjuster subassembly 240A; (iv) the tubular shaped adjuster spacer 240C; (v) the AB first end 242BA of the adjuster beam 242B for the second adjuster subassembly 240B; (vi) the FL first end 242AA of the first linkage 242A for the second adjuster subassembly 240B; and (vii) the arm second end 229B of the second support arm 230. The connector pin 238A connects all of these components together.

With this design, when the connector latch 238B is in the unlocked position, (i) the first linkages 242A for the adjuster assemblies 240A, 240B can be rotated simultaneously to adjust the height of the support frame 226 relative to the support arms 228, 230; and/or (ii) the adjuster beams 242B for the adjuster assemblies 240A, 240B can be rotated simultaneously to adjust the tilt of the support frame 226 relative to the support arms 230. As a result thereof, the height and tilt of the support frame 226 can be independently adjusted to suit the comfort of the person. With this design, the headrest assembly 12 can be moved relative to the device body 11 to suit the needs of the patient being massaged. After, the height and tilt have been adjusted, the connector latch 238B can be moved to the locked position 238I to inhibit further movement of the support frame 226.

Figure 2D:
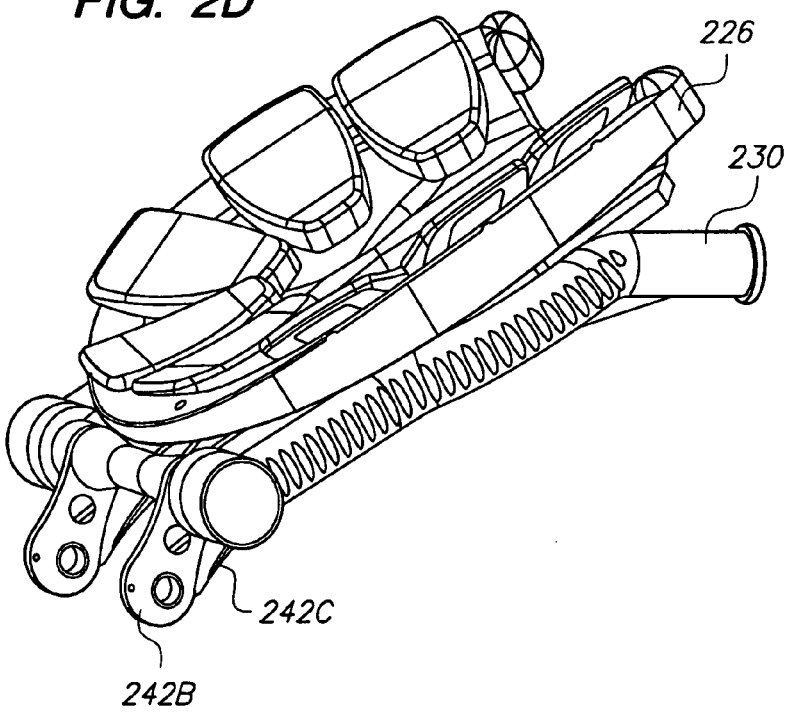
FIGS. 2D and 2E are alternative, perspective views of a portion of the headrest assembly of FIG. 2A.
Figure 2E:
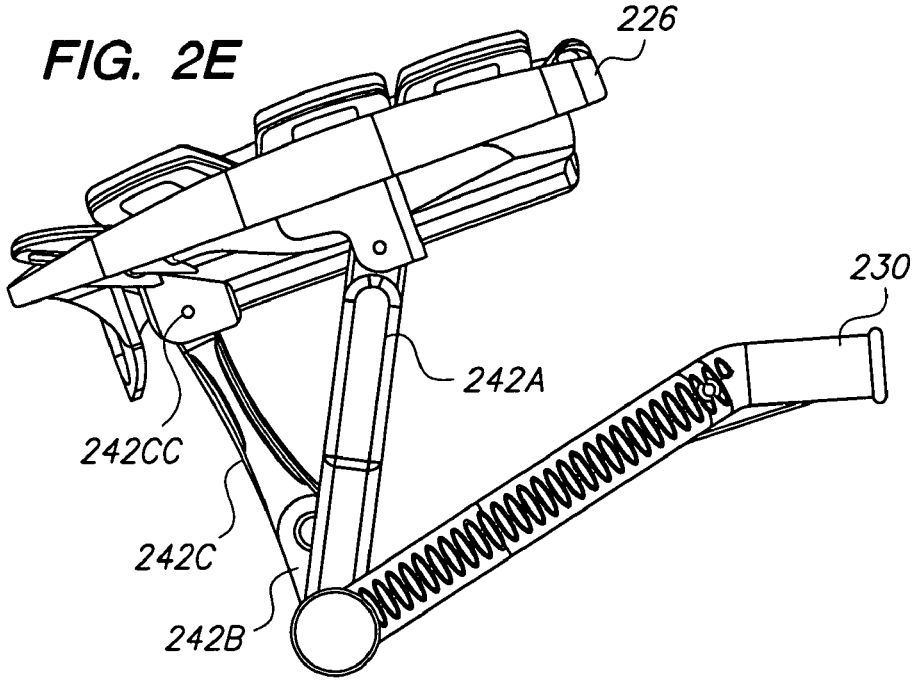

FIGS. 2D and 2E illustrate the support frame 226 in two different positions relative to the second support arm 230 (only a portion is illustrated in FIGS. 2D and 2E). More specifically, in FIG. 2D, the linkages 242A, 242C (the first linkage not visible in FIG. 2D) and the adjuster beams 242B have been rotated so that the support frame 226 is adjacent to the support arms 230. Further, in FIG. 2E, the linkages 242A, 242C and the adjuster beams 242B have been rotated so that the support frame 226 is spaced apart from the support arms 230.

As mentioned above, the first linkages 242A can be rotated simultaneously to adjust the height of the support frame 226 relative to the support arms 230. Stated in another fashion, the first linkages 242A can be used to adjust the elevation of the head 14 (illustrated in FIG. 1) relative to the rest of the massage device 10. In one, non-exclusive embodiment, the first linkages 242A are attached to the bottom of the support frame 226 near where the ear 17 (illustrated in FIG. 1) of the user is positioned. This is the approximate center of gravity of the head 14 (illustrated in FIG. 1).

Further, the adjuster beams 242B can be rotated simultaneously to adjust the tilt of the support frame 226 relative to the support arms 230. The tilt changes the balance of pressure on the top half of the face versus the lower half of the face. By adjusting the tilt, the pressure on the forehead and the shift of weight to the jaw and cheek can be easily adjusted.

It should be noted that the height and tilt of the support frame 226 can be independently adjusted to suit the comfort of the person. Further, the present design provides a relatively large range of height movement and tilt movement. For example, in alternative non-exclusive embodiments, the support frame 226 can be moved up and down approximately 2, 3, 4, 5, 6, 7 or 8 inches, and the support frame 226 can be tilted approximately −50, −40, −30, −20, −10, 10, 20, 30, 40 or 50 degrees. Alternatively, the range of movement of the support frame 226 can be greater or lesser than the amount detailed above.

Figure 2F:
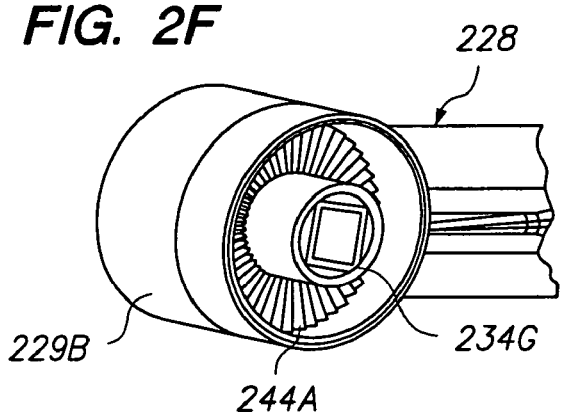
FIG. 2F is a perspective view of portion of a first arm section having features of the present invention.
Figure 2G:
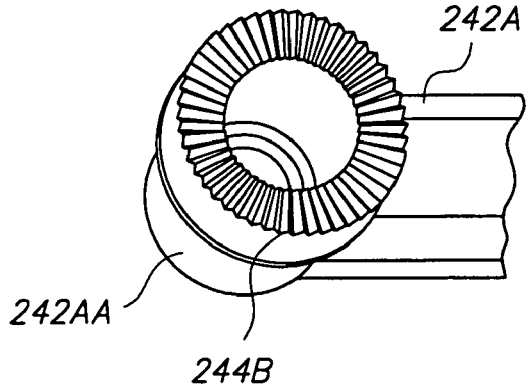
FIG. 2G is a perspective view of a portion of a first linkage having features of the present invention.

FIG. 2F illustrates a portion of arm second end 229B of the first support arm 228 and FIG. 2G illustrates the FL first end 242AA of the first linkage 242A. In this embodiment, the arm second end 229B of the first support arm 228 includes a first engagement area 244A and the first linkage 242A includes a second engagement area 244B that engages the first engagement area 244A to selectively inhibit relative rotation between the arm second end 229B of the first support arm 228 and the adjacent first linkage 242A. In one embodiment, each of the engagement areas 244A, 244B includes an annular ring shaped area having a plurality of teeth. With this design, when the engagement areas 244A, 244B are urged together by the connector latch 238B (illustrated in FIG. 2A), the engagement areas 244A, 244B inhibit relative rotation.

Alternatively, the engagement areas 244A, 244B can have a different configuration.

FIG. 2F also illustrates that the arm aperture 234G has a rectangular shaped cross-section as described above.

Referring back to FIG. 2C, when the connector latch 238B is in the locked position 238I, relative rotation between the adjuster spacer 240C, the first linkage 242A and the adjuster beam 242B of each adjuster subassembly 240A, 240B is inhibited. For example, the contact areas between the first linkage 242A, the adjuster beam 242B, and the adjuster spacer 240C can be slightly angled (e.g. 5 degrees) so that they can be pulled into tight engagement. Additionally, or alternatively, the contact surfaces can be made of materials that increase stiction and increases friction.

Figure 2H:
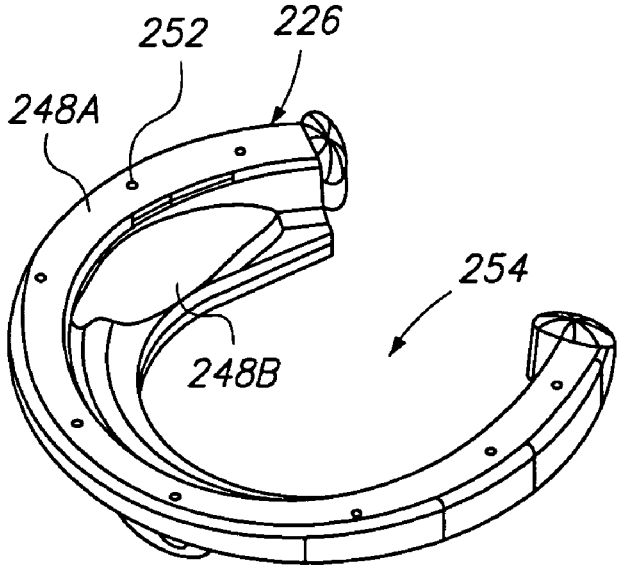
FIGS. 2H and 2I are alternative perspective views of a support frame having features of the present invention.
Figure 2I:
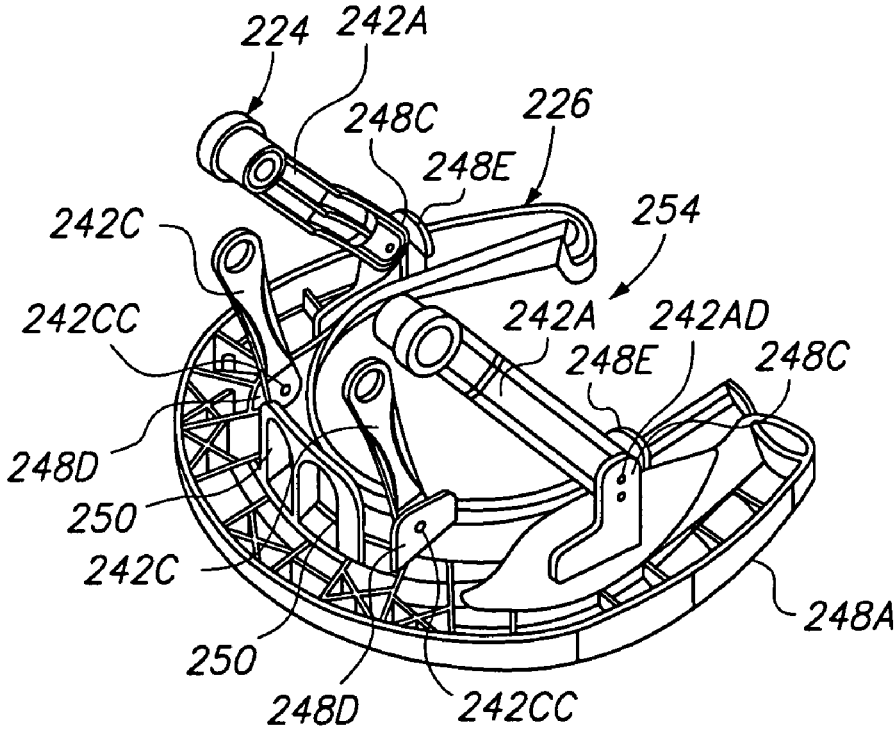

Referring back to FIG. 2A, the support frame 226 is coupled to the adjuster assembly 224 and supports the resilient assembly 220. FIG. 2H illustrates a top perspective view of one embodiment of the support frame 226, and FIG. 2I is a bottom perspective view of the support frame 226 and a portion of the adjuster assembly 224. In this embodiment, the support frame 226 is generally horseshoe-shaped or C-shaped, although the support frame 226 can have a different configuration. Further, the support frame 226 is rigid and can be formed at least partially from a rigid plastic, aluminum, or wood, as non-exclusive examples.

In FIGS. 2H and 2I, the support frame 226 includes a generally C-shaped upper frame section 248A and a generally C-shaped tapered frame section 248B that tapers inward and downward from the upper frame section 248. In one embodiment, the upper frame section 248A and the tapered frame section 248B includes a complex curve that allows the head rest assembly to contour to the face of the user. For example, the upper frame section 248A and the tapered frame section 248B can be higher at the cheek areas than the forehead area.

Additionally, a bottom of the support frame 226 includes a pair of spaced apart FL flanges 248C for securing the first linkages 242A to the support frame 226, and a pair of spaced apart SL flanges 248D for securing the second linkages 242C to the support frame 226. In one embodiment, each of the FL flanges 248C includes (i) an aperture for receiving the FL pin 242AD for pivotable connecting the first linkages 242A to the support frame 226, and (ii) a stop 248E that inhibits over rotation of the first linkages 242A. Further, each of the SL flanges 248D includes an aperture for receiving the SL pin 242CC for pivotable connecting the second linkages 242B to the support frame 226.

The support frame 226 can have a honeycomb wall type construction so that the support frame 226 is strong and lightweight.

Additionally, the support frame 226 can include one or more arm retainers 250 for retaining a portion of the support arms 228, 230 (illustrated in FIG. 2A) when the support arms 228, 230 are in the downsized position 236B (illustrated in FIG. 2B). In FIG. 2I, the arm retainers 250 are defined by a pair of apertures in a flange that cantilevers downward. In this embodiment, the one end of the first arm section 234A can be inserted into the retainers 250 for compact storage.

Moreover, the support frame 226 can include a plurality of SF apertures 252 in the upper frame section 248A for securing the resilient assembly 220 to the rest of the headrest assembly 212. Alternatively, the resilient assembly 220 can be secured to the rest of the headrest assembly 212 in another fashion.

In FIGS. 2H and 2I, the support frame 226 defines a generally horseshoe shaped frame opening 254.

Referring back to FIG. 2A, the resilient assembly 220 provides a soft and comfortable surface for the face of the person 16. In this embodiment, the resilient assembly 220 includes a first resilient subassembly 256 that is fixedly coupled to the support frame 226 and a second resilient subassembly 258 that engages the first resilient subassembly 256. With this design, the resilient subassemblies 256, 258 cooperate and act in parallel to support the face of the person 16. The size, shape and design of each of these components can be varied to achieve the desired design characteristics of the headrest assembly 212.

In certain embodiments, the resilient subassemblies 256, 258 cooperate to provide improved comfort and support to the face and/or head of the person on the message device. Further, the resilient subassemblies 256, 258 can better respond to the weight and shape of the head 14. Moreover, the resilient subassemblies 256, 258 can better conform and curve to the face to better "wrap", "envelop" or "cradle" the face.

Figure 3A:
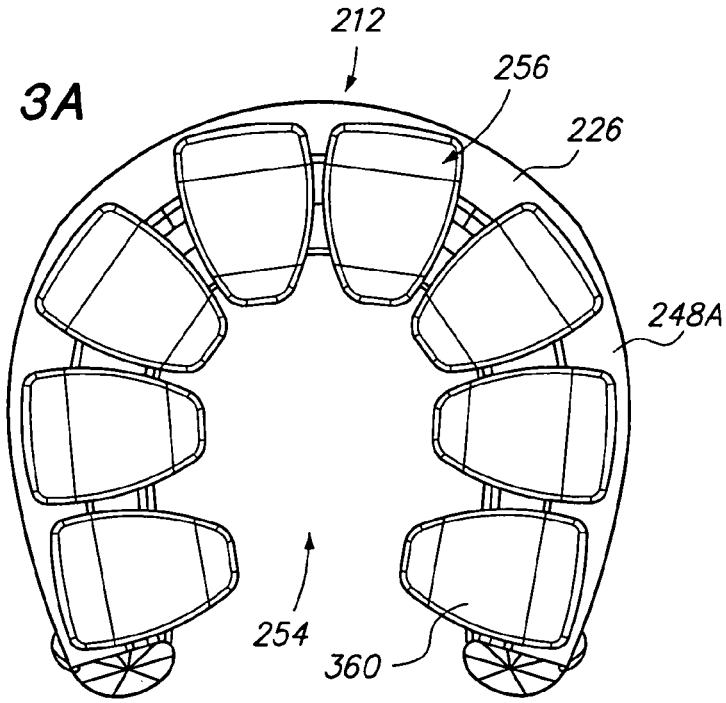
FIG. 3A is a top view of a portion of the headrest assembly of FIG. 2A.

FIG. 3A is a top view of the support frame 226 and the first resilient subassembly 256. In this embodiment, the first resilient subassembly 256 includes a plurality of spaced apart resilient members 360 that are secured to the support frame 226 around the perimeter of the upper frame section 248A, and that cantilever inward from the support frame 226 into the frame opening 254. The number and design of resilient members 360 can vary. In FIG. 3A, the first resilient subassembly 256 includes eight resilient members 360. Alternatively, for example, the resilient subassembly 256 could be designed to include more than eight or less than eight resilient members 360.

It should be noted that in FIG. 3A, all of the resilient members 360 have are similar in size, shape and design to reduce manufacturing costs. Alternatively, one or more of the resilient members 360 could have a different size, shape, bending characteristics, or design to suit the area of the face supported by that particular resilient member 360.

The comfort of the headrest 12 is a combination of the posture and face position. Face pressure is best when low and uniform. This can be achieved by the conforming the resilient assembly 220 to the shape of the face. In one embodiment, the second resilient assembly 258 (illustrated in FIG. 2A) conforms in reaction to the loading. Further, the first resilient assembly 256 responds to the load in both the vertical elevation and in the slope of the resilient members 360.

FIG. 3A illustrates that in one embodiment, the support frame 226 has a cylindrical curve and the resilient members 360 have another curve. Because the resilient members 360 are arranged in a horse shoe array, the top of the resilient members 360 consist of both cylindrical and spherical curves. In one embodiment, the cylindrical radius and the spherical radius are both larger than the head and face of a person. This allows the resilient assembly 220 to fold-in from an open flower into a smaller space when the head is pressed into the resilient assembly 220.

Figure 3B:
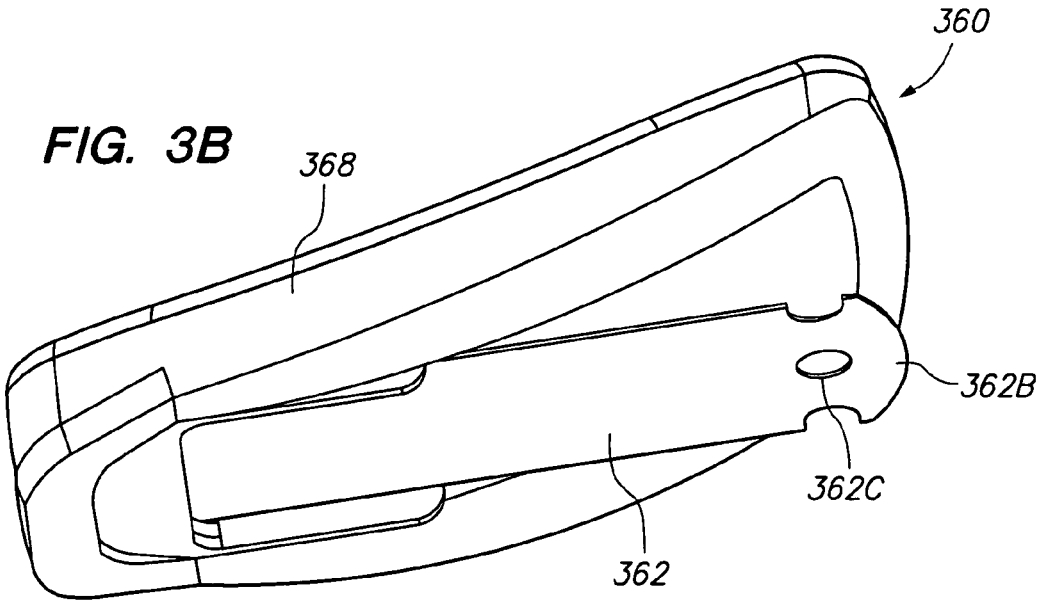
FIGS. 3B-3D are alternative views of a resilient member having features of the present invention.
Figure 3C:
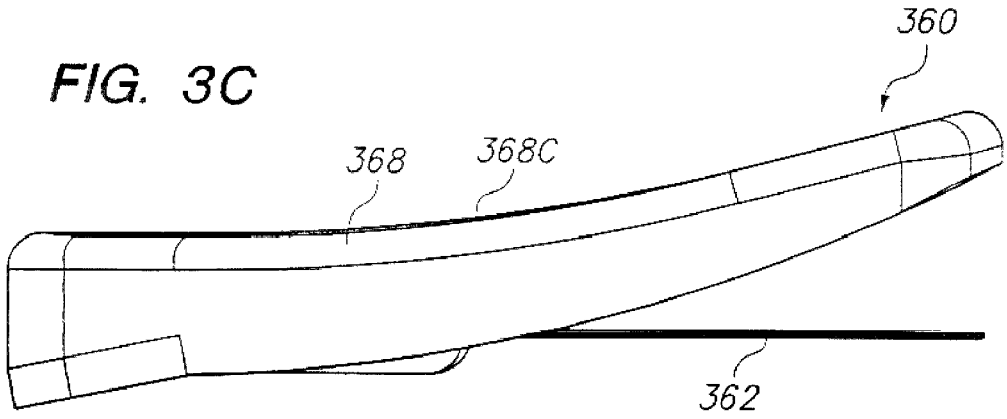
Figure 3D:
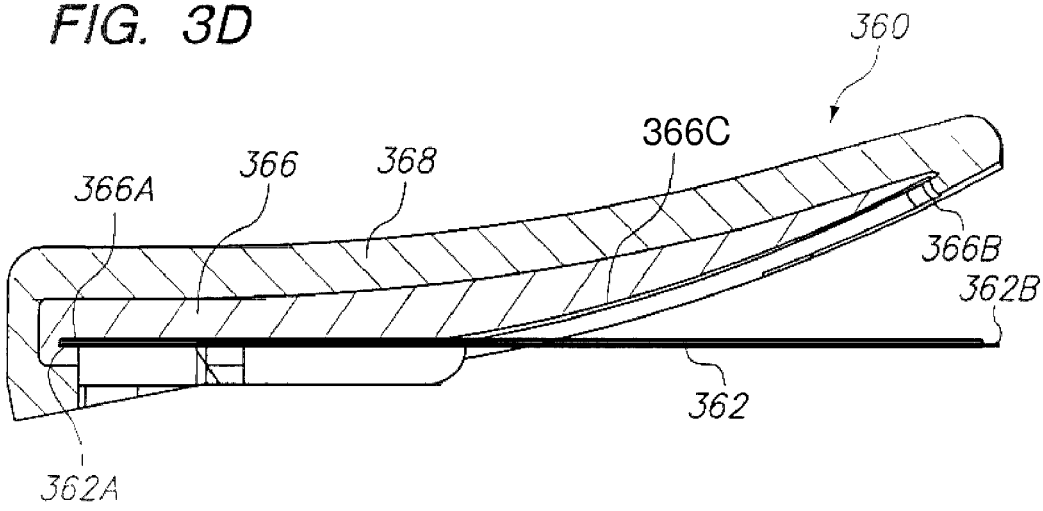

FIG. 3B is a perspective view, FIG. 3C is a side view, and FIG. 3D is a cut-away view of one embodiment of the resilient members 360. In this embodiment, the resilient member 360 includes a resilient first beam 362, a second resilient beam 366, and a resilient cover 368 that cooperate to define the resilient member 360. However, the resilient member 360 can have another design.

In this embodiment, the resilient first beam 362 is generally flat, rectangular plate shaped and is made of resilient material, such as spring steel. The resilient first beam 362 includes a first end 362A that cantilevers away from the support frame 226 and a second end 362B that includes a RFB aperture 362C for securing the resilient member 360 to the support frame 226.

The second resilient beam 366 is generally curved plate shaped and is made of resilient material. The second resilient beam 366 includes a first end 366A that is fixedly secured to the first end 362A of the first resilient beam 362 and a second end 366B that cantilevers away from the first end 366A back towards the support frame 226 and upward. In one, non-exclusive embodiment, the second resilient beam 366 can have a curved region 366C having a relatively large radius.

The second resilient beam 366 provides a relatively hard cover that provides a large surface area. In one embodiment, the second resilient beam 366 is a relatively hard plastic that is molded over the first end 362A of the first beam 362 and the second beam 364.

The resilient cover 368 provides a relatively soft covering over the second resilient beam 366. In one embodiment, the resilient cover 368 is a soft foam rubber that is molded over the second resilient beam 366. Suitable materials for the resilient cover 368 include natural rubber, foam rubber, urethane rubber, and thermal plastic elastomer. Additionally, the resilient cover 368 can define a member engagement surface 368C that engages the second resilient subassembly 258 in a non-skid fashion. For example, the member engagement surface 368C can have a relatively high coefficient of friction and/or can be a rough surface.

It should be noted that the characteristics of the resilient first beam 362 and/or the characteristics of the second resilient beam 366 can be adjusted to suit the support requirements of the resilient members 360. For example, the thickness and/or the materials used in one or both of the beams 362, 366 can be altered to suit the support requirements. In one embodiment, if it is desired to have more support at the forehead instead of the cheeks, the first beams 362 used at the forehead can be thicker than the first beams 362 used near the cheek. Thus, with certain versions, the resilient members 360 can be designed to achieve the desired support characteristics.

Additionally, it should be noted that the cantilevering end of the resilient member 360 can engage the tapered frame section 248B to inhibit over travel of the resilient member 360.

Figure 3E:
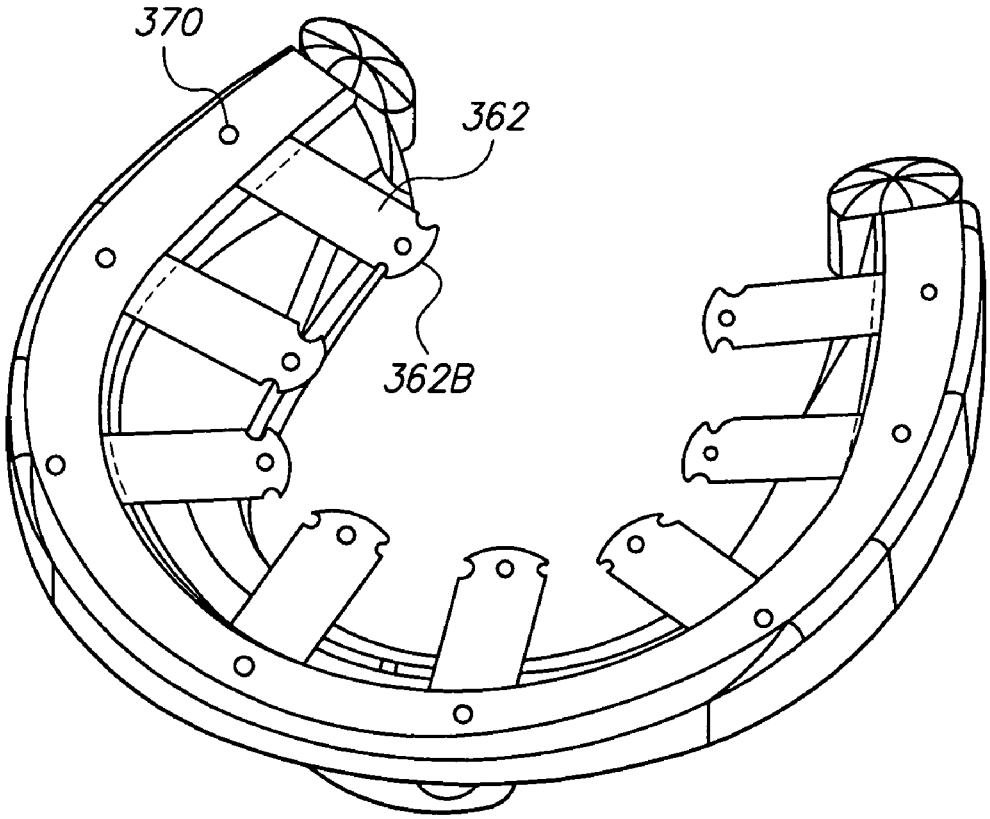
FIG. 3E is a top perspective view of a portion of the headrest assembly of FIG. 2A.

FIG. 3E illustrates the support frame 226 and that the first beams 362 can be secured with fasteners 370 to the support frame 226. As non-exclusive examples, the fasteners 370 can be rivets or screws. Alternatively, the resilient members 360 can be fastened to the support frame 226 in another fashion.

It should be noted that two or more of the first beams 362 can be made as a unitary structure that is attached to the support frame 226.

Figure 3F:
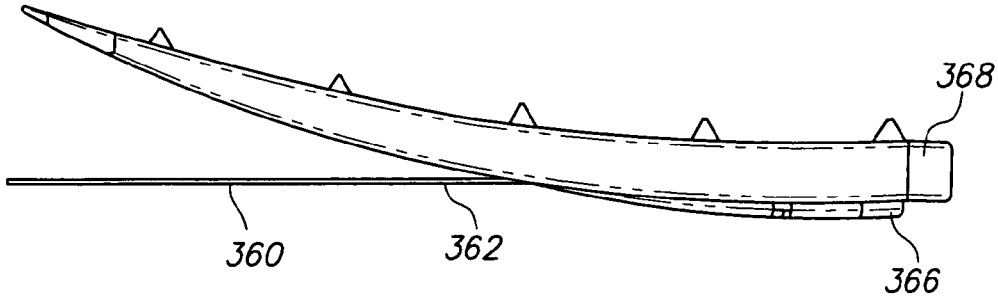
FIGS. 3F-3H illustrate one embodiment of the resilient members 360 at different stages of bending.
Figure 3G:
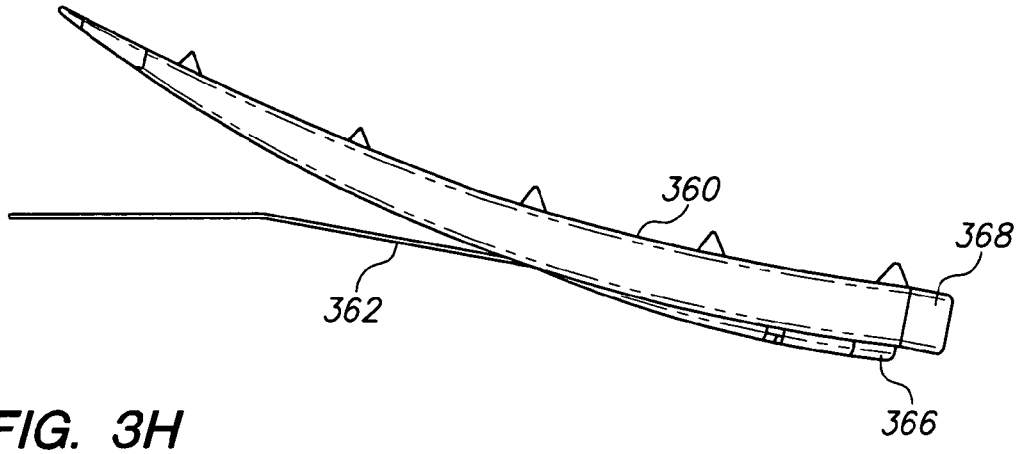
Figure 3H:
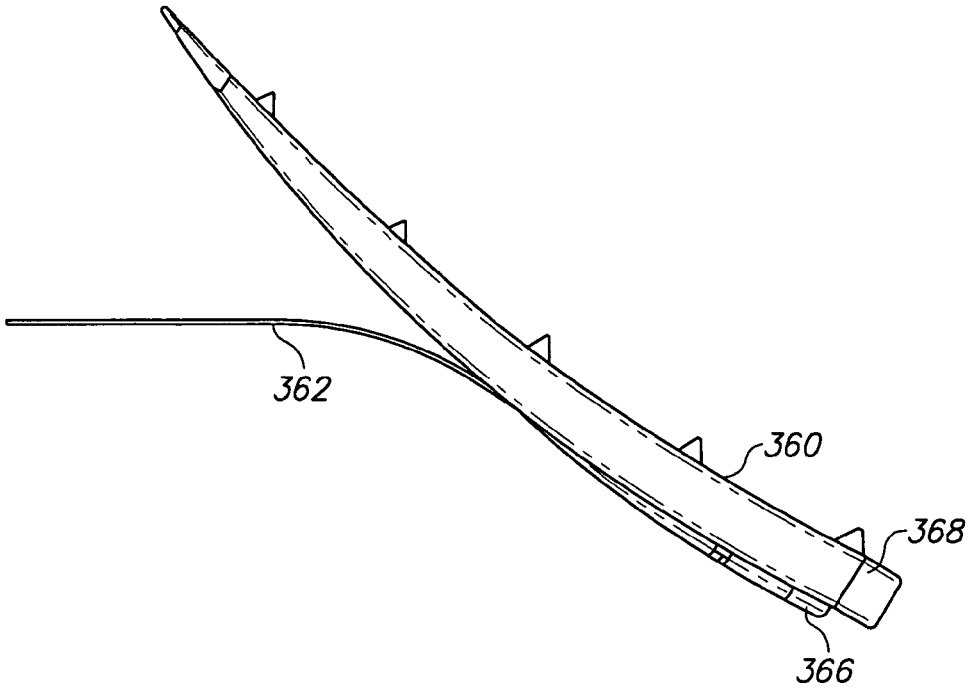

FIGS. 3F-3G illustrate one embodiment of the resilient members 360 at different stages of bending. More specifically, FIG. 3F illustrates the resilient member 360 prior to bending, FIG. 3G illustrates the resilient member 360 during initial bending, and FIG. 3H illustrates the resilient member 360 near a fully bend condition. These Figures illustrate that the first beam 362 bends downward and the curved second beam 366 bends downward and curves to cradle and conform to the face. With this design, the cover 368 is substantially parallel with the face when the resilient member 360 is flexed.

Referring back to FIG. 2A, in one embodiment, the second resilient subassembly 258 stacks on top of the first resilient subassembly 256. With this design, the resilient subassemblies 256, 258 cooperate to provide improved comfort to the user. The design of the second resilient subassembly 258 can vary. In FIG. 2A, the second resilient subassembly 258 is generally horseshoe or "C" shaped.

Figure 4A:
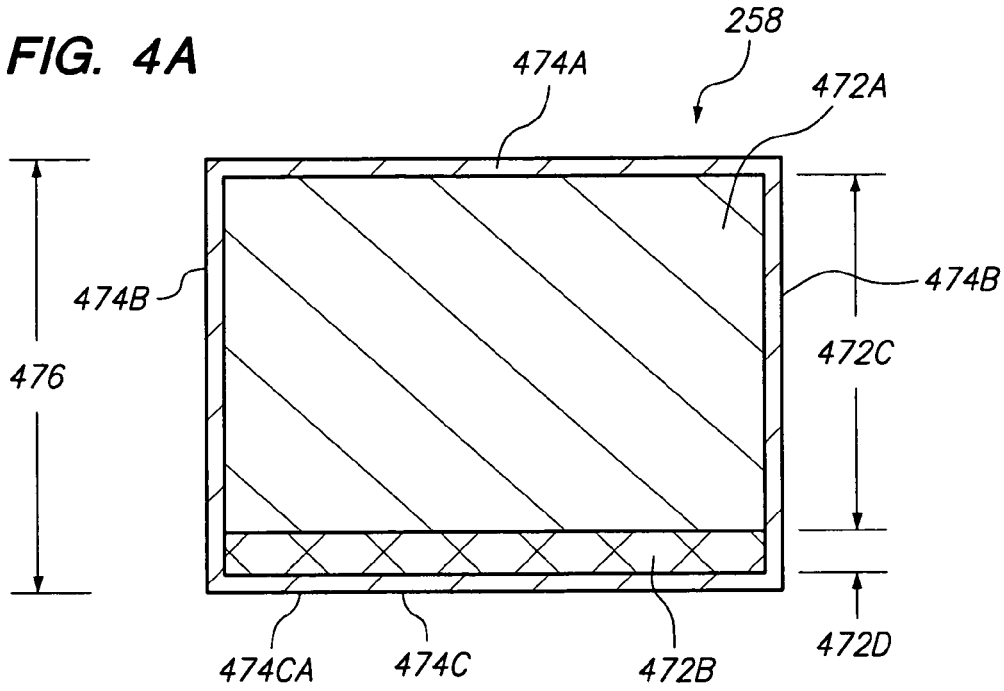
FIG. 4A is a cut-away view taken on line 4A-4A of FIG. 2A.

FIG. 4A is a cut-away view of one, non-exclusive embodiment of the second resilient subassembly 258 taken on line 4A-4A in FIG. 2A. In this embodiment, the second resilient subassembly 258 includes an interior resilient region 472 and an outer covering 474. Further, in this embodiment, the interior resilient region 472 includes a first layer 472A and a second layer 472B that are stacked together with the first layer 472A positioned on top of the second layer 472B.

In one embodiment, the first layer 472A and the second layer 472B are each made of a foam material. However, in certain embodiments, the stiffness of each layer 472A, 472B is different. For example, the first layer 472A can have a first stiffness that is different than a second stiffness of the second layer 472B. In alternative non-exclusive embodiments, the first stiffness is at least approximately 90, 80, 70, 60, 50, 40, 30, 20, or 10 percent less stiff than the second stiffness. For example, the first section 472A can be made of four or five pound (5 pound density per cubic foot) memory foam and the second section 472B can be six pound (6 pound density per cubic foot) memory foam, neoprene foam or stiffer memory foam.

With this design, in certain embodiments, the first layer 472A is softer and closer to the face of the user and the second layer 472B is harder and is positioned away from the face. As a result thereof, in certain embodiments, the softer first layer 472A is able to conform to the smallest features of the face while the second layer 472B is stiffer and conforms less than the first layer 472A. In certain embodiments, the stiffer second layer 472B can inhibit indirect contact (bottoming out of the interior resilient region 472) between the face and the rest of the headrest below the second layer 472B.

Further, in certain embodiments, the thickness of each layer 472A, 472B is different. In FIG. 4A, the first layer 472A has a first thickness 472C that is different than a second thickness 472D of the second layer 472B. In alternative, non-exclusive embodiments, the first thickness 472C can be approximately 2, 3, 5, 6, 8, 10, or 12 times greater than the second thickness 472D. Stated in another fashion, the in alternative, non-exclusive embodiments, the first thickness 472C can be approximately ½, 1, 2, 3, 4, or 5 inches, and the second thickness 472D can be approximately ⅛, ⅙, ¼, ⅜, ½ or ¾ inches. Alternatively, the thicknesses 472C, 472D can be different than these amounts.

Still alternatively, the interior resilient region 472 could be design without multiple layers or with more than two layers.

The outer covering 474 protects the interior resilient region 472. In one embodiment, the outer covering 474 is designed to allow for enhanced flexing and bending of the second resilient subassembly 258 so that the second resilient subassembly 258 can conform to the face of the user 16. In this embodiment, the outer covering 474 includes a top 474A, a pair of opposed sides 474B, and a bottom 474C that cooperate to encircle and enclose the interior resilient material 472.

In one embodiment, the top 474A and the opposed sides 474B are made of first material that is not very stretchable and the bottom 474C is made of a second material that is stretchable. For example, the first material can be leather or vinyl, and the second material can be made of a nylon rib knit or Polartech fleece fabric. With this design, when the bottom 474C is engaging the individual resilient members 360, the flexible bottom 474C allows the second resilient subassembly 258 to easily bend to conform to the face of the user 16.

In one embodiment, the bottom 474C includes a bottom engagement surface 474CA that engages the top of the resilient members 360 and the high friction interface between these components secures the second resilient subassembly 258 to the first resilient subassembly 256. Stated in another fashion, the bottom 474C engages the top of the resilient members 360 in a non-slip fashion with the friction between the surfaces inhibiting relative movement. Further, the bottom 474C flexes and stretches to maintain a surface contact area between the bottom 474C and the resilient members 360 so that the components act like they are fixedly secured together and bend together.

Alternatively, hook and loop type fasteners can be utilized. Further, any other suitable method can be used to secure the resilient subassemblies 256, 258 together. For example, the second resilient subassembly 258 can use an elastic rim somewhat similar to a shower cap to secure the resilient subassemblies 256, 258 together.

It should be noted that in certain embodiments, a thinner second resilient subassembly 258 can be utilized. For example, in alternative, non-exclusive embodiments, the second resilient subassembly 258 has a SRS thickness 476 of approximately 1, 1.5, 2 or 2.5 inches. However, other thicknesses can be utilized.

Figure 4B:
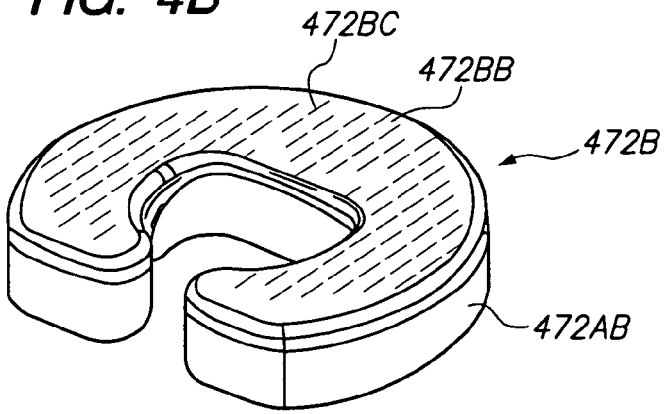
FIG. 4B is a bottom perspective view of an interior resilient region.

In certain embodiments, during usage, the eight resilient members 360 can seek their own equilibrium position depending on the shape of the head 14. In general, the nose and mouth opening will expand as the head 14 is pressed into the headrest under the weight of the person. Additionally, in certain embodiments, the second resilient subassembly 258 should be flexible to allow the resilient members 360 to independently flex to contour to the face of the user FIG. 4B is a bottom perspective view of another embodiment of an interior resilient region 472B including the first layer 472AB and the second layer 472BB. In this embodiment, the second layer 472BB is a relatively stiff piece of foam that includes a plurality of spaced apart cut-outs 472BC that reduce the lateral stiffness of the second layer 472BB. As a result thereof, the second resilient subassembly 258 is softer and more bendable and allows the resilient members 360 to independently flex.

As an example, the second layer 472BB can include a piece of Q-31 foam which is sold by G & M Foam, located in California.

In one embodiment, the cut-outs 472BC reduce the strength of the second layer 472BB in tension while not significantly influencing the strength of the second layer 472BB in compression. For example, the cut-outs 472BC can be die-cut and arranged in a pattern to soften the second layer 472BB to allow for increased lateral stretch (from left ear to right ear) while not significantly influencing how the second layer 472BB compresses up and down. Stated in another fashion, the cut-outs 472BC change the stiffness of the second layer 472BB in tension without significantly influencing the compression properties of the second layer 472BB in any direction, including up and down. With this design, in certain embodiments, the second layer 472BB provides the desired support up and down while allowing for the second layer 472BB to flex and stretch laterally. In FIG. 4B, the cut-outs 472BC are slots that are aligned in spaced apart rows that extend from the top to the bottom of the second layer 472BB. In one embodiment, the slots extend through the entire thickness of the second layer 472BB. Further, in certain embodiments, at least some of the slots turn into circles or ovals during bending of the second layer 472BB. Alternatively, the cut-outs 472BC can have a different shape, depth and pattern than that illustrated in FIG. 4B.

In certain embodiments, the die-cut second layer 472BB is weak and can be damaged, has a thickness of approximately 0.625 inches, and is bonded to a 2 inch thick piece of memory foam first layer 472AB to improve strength and durability.

In yet another embodiment, the second resilient subassembly 258 can include a piece of memory foam cushion that is enclosed with a Polartec fleece cover. In some cases, 1 inch thick of memory foam is sufficient. One advantage of this design is that both materials can stretch and follow the opening of the second resilient subassembly 258.

Figure 5:
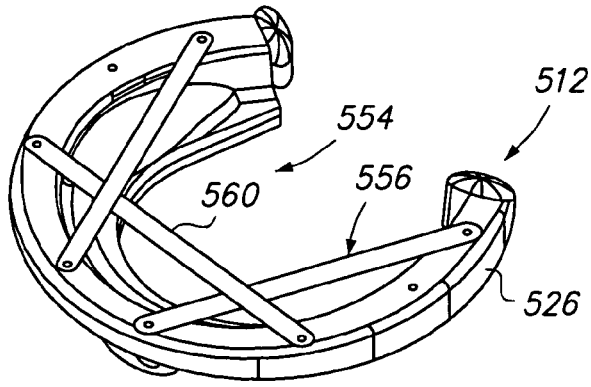
FIG. 5 is a top perspective view of another embodiment of a portion of a headrest assembly having features of the present invention.

FIG. 5 is a top perspective view of another embodiment of a portion of a headrest assembly 512 having features of the present invention. More specifically, FIG. 5 illustrates a support frame 526 that is similar to the corresponding component described above and another embodiment of the first resilient subassembly 556. In this embodiment, the first resilient subassembly 556 again includes a plurality of resilient members 560. However, in this embodiment, each of the resilient members 560 is an elastic band or strap that is secured to the support frame 526. The orientation and number of resilient members 560 can vary. In FIG. 5, each of the ends of the each of the resilient members 556 is secured to the support frame 526 and the resilient members 560 span across portions of the frame opening 554.

In this embodiment, the second resilient subassembly 258 (illustrated in FIG. 2A) can engage and be stacked on top of the resilient members 560.

Figure 6:
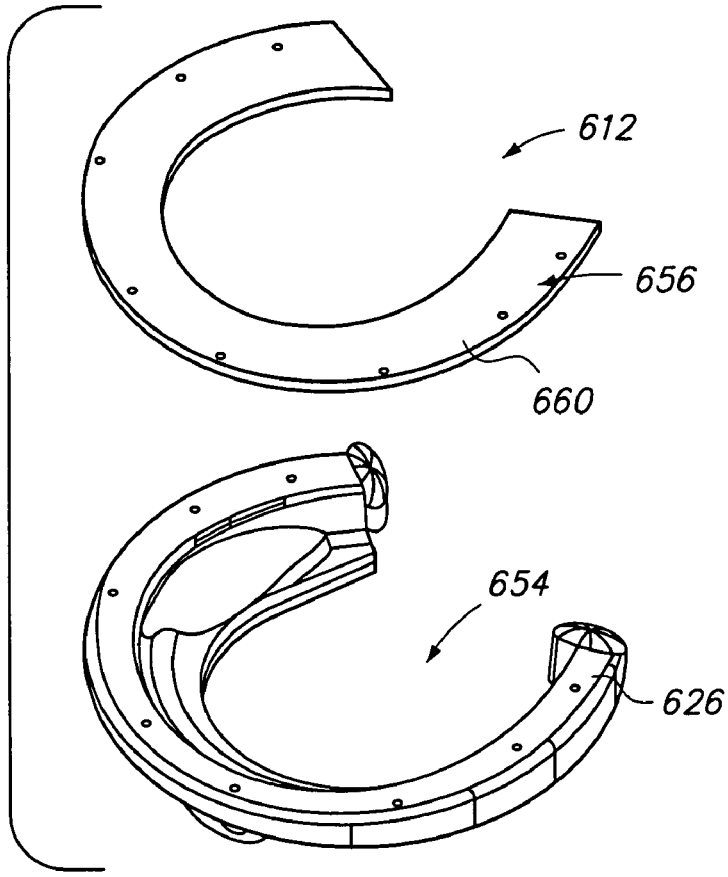
FIG. 6 is an exploded, top perspective view of yet another embodiment of a portion of a headrest assembly having features of the present invention.

FIG. 6 is a top perspective view of another embodiment of a portion of a headrest assembly 612 having features of the present invention. More specifically, FIG. 6 illustrates a support frame 626 that is similar to the corresponding component described above and another embodiment of the first resilient subassembly 656. In this embodiment, the first resilient subassembly 656 includes a single, horse-shoe shaped, resilient member 660 that is secured to the support frame 626. In FIG. 6, the resilient member 660 cantilevers into the frame opening 654. Further, the resilient member 660 can be formed from a relatively thin, compliant rubber material.

In this embodiment, the second resilient subassembly 258 (illustrated in FIG. 2A) can engage and be stacked on top of the resilient member 660.

Figure 7A:
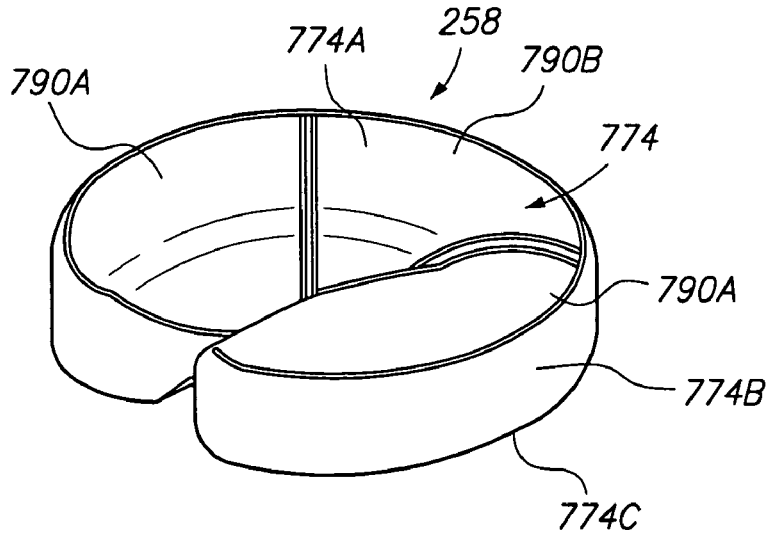
FIG. 7A is a top perspective view and FIG. 7B is an exploded bottom perspective view of an outer covering.
Figure 7B:
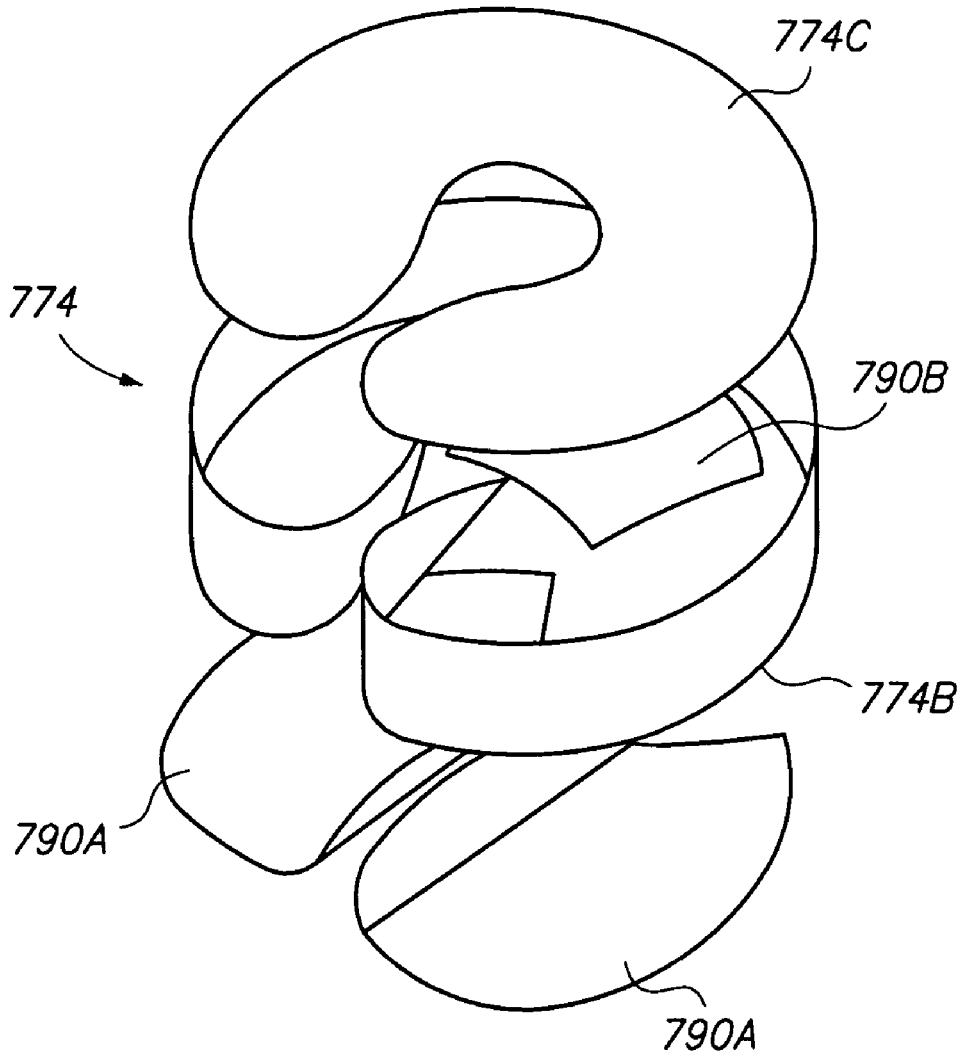

FIG. 7A is a top perspective view and FIG. 7B is an exploded bottom perspective view of outer covering 774 that can be used for the second resilient subassembly 258 (illustrated in FIG. 2A). In one embodiment, effort is made to allow the outer covering 774 to stretch while providing a surface that engages the face that can be easily cleaned. In one embodiment, the top 774A is sewn together with 3 sections, namely a pair of spaced apart cheek sections 790A that engage the cheeks of the user and a forehead section 790B that engages the forehead of the user. Moreover, the outer covering 774 includes the bottom 774C and the sides 774B. In one embodiment, the cheek sections 790A and the forehead section 790B also define the inner circumference of the covering 774.

In one embodiment, the sections of the outer covering 774 are sewn together in a fashion to avoid a sewing seam that extends from the left eye to the right eye. As a result thereof, the outer covering 774 allows for more lateral stretching.

Additionally, in one embodiment, the sections of the top 774A and the sides 774B are made of a durable material that can be easily cleaned and that resists stains such as vinyl or leather. Further, the bottom 774C is made with a stretchable, rib knit material that can stretch 4 ways. In one embodiment, the most elastic direction is oriented from the left the right. With this design, in certain embodiments, the portions of the outer covering 774 that are engaged by the face can be readily cleaned and the portion that engages the resilient members 360 can easily stretch to conform to the movement of the resilient members 360.

Figure 8:
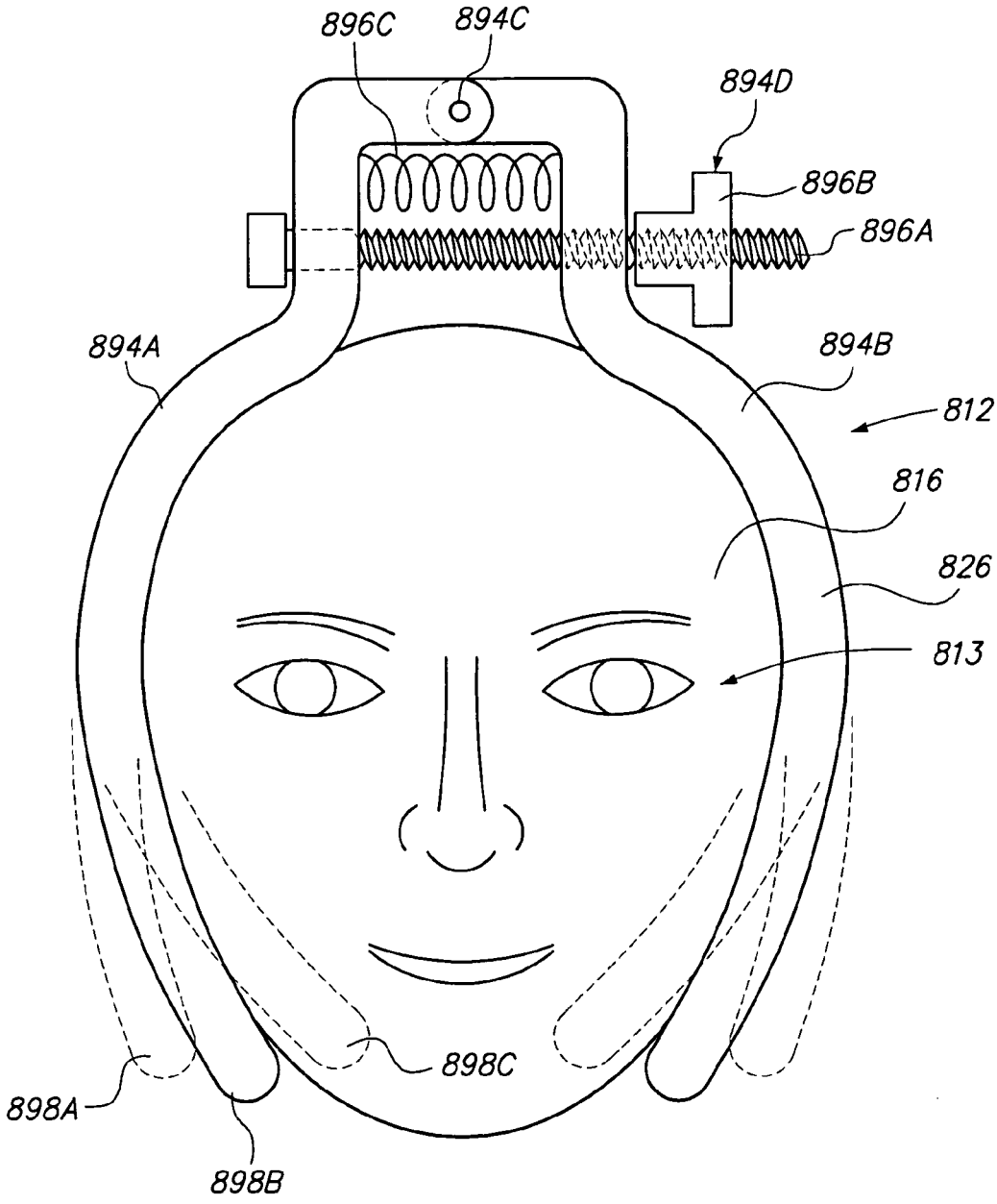
FIG. 8 is a simplified illustrated view of a headrest assembly.

FIG. 8 is a simplified illustrated view of another embodiment of a headrest assembly 812. FIG. 8 also illustrates a face 813 of a person 816. In this embodiment, the width of the support frame 826 can be easily adjusted to adjust to different sizes and shapes of faces 813 and/or jaws.

The design of the adjustable support frame 826 can vary. In the embodiment illustrated in FIG. 8, the adjustable support frame 826 includes a first frame section 894A, a second frame section 894B, a section connector 894C, and a section adjuster 894D. In this embodiment, the first frame section 894A is rigid and is positioned along the right side of the face 813, and the second frame section 894B is rigid and is positioned along the left side of the face 813.

The section connector 894C connects the frame sections 894A, 894B together and allows the frame sections 894A, 894B to move relative to each other to adjust the width of the support frame 826. In FIG. 8, the section connector 894C is a pin that pivotably connects the frame sections 894A, 894B.

The section adjuster 894D can be used to precisely adjust the positions of the frame sections 894A, 894B to adjust the width of the support frame 826. In FIG. 8, the section adjuster 894D includes an externally threaded member 896A, an internally threaded knob 896B that engages the externally threaded member 896A, and a bias member 896C that urges the frame sections 894A, 894B apart. With this design, rotation of the knob 896B in the clockwise direction causes the distance between the distal ends of frame sections 894A, 894B to become more narrow, and rotation of the know 896B in the counter-clockwise direction causes the distance between the distal ends of frame sections 894A, 894B to become wider. In FIG. 8, a portion of the frame sections 894A, 894B is illustrated at a first position 898A (in phantom) which is the widest, a portion of the frame sections 894A, 894B is illustrated at a second position 898B which is narrower than the first position 898A, and a portion of the frame sections 894A, 894B is illustrated at a third position 898C (in phantom) which is the narrowest. It should be noted that the frame sections 894A, 894B can be adjusted to other positions than that illustrated in FIG. 8.

Only the support frame 826 is illustrated in FIG. 8. It should be noted that the headrest assembly 812 can be designed to be implemented in the headrest assembly 12 of FIG. 2A. For example, the headrest assembly 812 can include the first resilient subassembly and/or the second resilient subassembly described above.

While the current invention is disclosed in detail herein, it is to be understood that it is merely illustrative of the presently preferred embodiments of the invention and that no limitations are intended to the details of construction or design herein shown other than as described in the appended claims.

What is claimed is:

1. A headrest assembly for supporting a face of a user of a massage device, the headrest assembly comprising:

a resilient assembly that supports the face of the user;

a support frame that supports the resilient assembly;

a support arm assembly that is secured to the massage device; and an adjuster assembly that can be used to adjust the position of the resilient assembly relative to the support arm assembly, the adjuster assembly including a first adjuster subassembly that forms a first, four bar type linkage assembly, wherein the support frame forms a portion of the first, four bar type linkage assembly, the first adjuster subassembly including (i) a first linkage that extends between and is pivotably connected to the support arm assembly and the support frame, (ii) an adjuster beam that extends away from and is pivotably connected to the support arm assembly, and (iii) a second linkage that extends between and is pivotably connected to the adjuster beam and the support frame.

2. The headrest assembly of claim 1 wherein the adjuster assembly includes a second adjuster subassembly that is spaced apart from the first adjuster subassembly, the second adjuster subassembly forms a second, four bar type linkage assembly.

3. The headrest assembly of claim 2 wherein the support frame forms a portion of the first, four bar type linkage assembly and a portion of the second, four bar type linkage assembly.

4. The headrest assembly of claim 1 wherein pivoting of the first linkage relative to the support arm assembly causes the support frame to move up or down relative to the support arm assembly and wherein pivoting of the adjuster beam relative to the support arm assembly causes the support frame to pivot relative to the support arm assembly.

5. The headrest assembly of claim 4 wherein the support frame includes an ear region and a forehead region and wherein the first linkage is connected to the support frame near the ear region and the second linkage is connected to the support frame near the forehead region.

6. The headrest assembly of claim 1 wherein the first linkage and the adjuster beam rotate relative to each other.

7. A massage device comprising a massage base and the headrest assembly of claim 1 coupled to the massage base.

8. A headrest assembly for supporting a face of a user of a massage device, the headrest assembly comprising:

a resilient assembly that supports the face of the user;

a support frame that supports the resilient assembly, the support frame including an ear region and a forehead region;

a support arm assembly that is secured to the massage device; and an adjuster assembly that can be used to adjust the position of the resilient assembly relative to the support arm assembly, the adjuster assembly including a first adjuster subassembly having a first linkage that is coupled to the support frame near the ear region, a second linkage that is coupled to the support frame near the forehead region, and an adjuster beam that is coupled to the second linkage; wherein the first linkage is connected to the support arm assembly and pivots relative to an axis and the adjuster beam is connected to the support arm assembly and pivots relative to the axis.

9. The headrest assembly of claim 8 wherein the first adjuster subassembly forms a first, four bar type linkage assembly.

10. The headrest assembly of claim 9 wherein the adjuster assembly includes a second adjuster subassembly that is spaced apart from the first adjuster subassembly, the second adjuster subassembly forms a second, four bar type linkage assembly.

11. The headrest assembly of claim 9 wherein the support frame forms a portion of the first, four bar type linkage assembly.

12. The headrest assembly of claim 8 wherein pivoting of the first linkage relative to the support arm assembly causes the support frame to move up or down relative to the support arm assembly and wherein pivoting of the adjuster beam relative to the support arm assembly causes the support frame to pivot relative to the support arm assembly.

13. A massage device comprising a massage base and the headrest assembly of claim 8 coupled to the massage base.

14. A headrest assembly for supporting a face of a user of a massage device, the headrest assembly comprising:

a resilient assembly that supports the face of the user;

a support frame that supports the resilient assembly, the support frame including an ear region and a forehead region;

a support arm assembly that is secured to the massage device; and an adjuster assembly that can be used to adjust the position of the resilient assembly relative to the support arm assembly, the adjuster assembly including a first adjuster subassembly having a first linkage that is coupled to the support frame near the ear region and a second linkage that is coupled to the support frame near the forehead region; wherein the first adjuster subassembly includes an adjuster beam that extends away from the support arm assembly, and wherein the second linkage that extends between the adjuster beam and the support frame and wherein (i) the first linkage is pivotably connected to the support arm assembly and the support frame, (ii) the adjuster beam is pivotably connected to the support arm assembly, and (iii) the second linkage is pivotably connected to the adjuster beam and the support frame.

15. The headrest assembly of claim 14 wherein the first linkage and the adjuster beam rotate relative to each other.

16. A method for supporting a face of a user of a massage device, the method comprising the steps of:

supporting the face of the user with a resilient assembly;

supporting the resilient assembly with a support frame;

securing a support arm assembly to the massage device; and adjusting the position of the resilient assembly relative to the support arm assembly with an adjuster assembly, the adjuster assembly including a first adjuster subassembly that forms a first, four bar type linkage assembly, wherein the support frame forms a portion of the first, four bar type linkage assembly, the first adjuster subassembly including (i) a first linkage that extends between and is pivotably connected to the support arm assembly and the support frame, (ii) an adjuster beam that extends away from and is pivotably connected to the support arm assembly, and (iii) a second linkage that extends between and is pivotably connected to the adjuster beam and the support frame.

17. A headrest assembly for supporting a face of a user of a massage device, the headrest assembly comprising:

a resilient assembly that supports the face of the user;

a support arm assembly that is secured to the massage device; and an adjuster assembly that can be used to adjust the position of the resilient assembly relative to the support arm assembly, the adjuster assembly including a first adjuster subassembly that forms a first, four bar type linkage assembly, wherein the first adjuster subassembly includes a first bar that is connected to the support arm assembly and pivots relative to an axis and a second bar that is connected to the support arm assembly and pivots relative to the axis.

18. The headrest assembly of claim 17 wherein the adjuster assembly further includes a second adjuster subassembly that is spaced apart from the first adjuster subassembly, wherein the second adjuster subassembly includes a first bar that is connected to the support arm assembly and pivots relative to the axis and a second bar that is connected to the support arm assembly and pivots relative to the axis.

19. The headrest assembly of claim 18 wherein the support arm assembly includes an arm connector that extends between the first adjuster subassembly and the second adjuster subassembly, the arm connector being positioned along the axis.

20. The headrest assembly of claim 19 wherein the first bar and the second bar of the first adjuster subassembly and the first bar and the second bar of the second adjuster subassembly each pivot relative to the arm connector.

21. The headrest assembly of claim 19 wherein the arm connector includes a connector latch that is selectively movable between an unlocked position and a locked position, wherein when the connector latch is in the unlocked position the first bar and the second bar of the first adjuster subassembly and the first bar and the second bar of the second adjuster subassembly can each pivot relative to the arm connector, and wherein when the connector latch is in the locked position the first bar and the second bar of the first adjuster subassembly and the first bar and the second bar of the second adjuster subassembly are inhibited from pivoting relative to the arm connector.

22. A headrest assembly for supporting a face of a user of a massage device, the headrest assembly comprising:

a resilient assembly that supports the face of the user;

a support frame that supports the resilient assembly;

a support arm assembly that is secured to the massage device; and an adjuster assembly that can be used to adjust the position of the resilient assembly relative to the support arm assembly, the adjuster assembly including a first adjuster subassembly including a first bar that extends between and is pivotably connected to the support arm assembly and the support frame, and a second bar and a third bar that cooperate to extend between and be pivotably connected to the support arm assembly and the support frame, wherein the support frame forms a portion of the first adjuster subassembly; wherein the first bar pivots relative to the support arm assembly about an axis, and wherein the second bar is connected to the support arm assembly and pivots relative to the support arm assembly about the axis.

* * * * *

UNITED STATES PATENT AND TRADEMARK OFFICE

CERTIFICATE OF CORRECTION

PATENT NO. : 7,610,639 B2
APPLICATION NO. : 11/452835
DATED : November 3, 2009
INVENTOR(S) : Roleder et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 495 days.

Signed and Sealed this

Twelfth Day of October, 2010

David J. Kappos

David J. Kappos
*Director of the United States Patent and Trademark Office*